US007731819B2

(12) United States Patent
Awofeso et al.

(10) Patent No.: US 7,731,819 B2
(45) Date of Patent: Jun. 8, 2010

(54) METHOD OF MAKING CREPED TOWEL AND TISSUE INCORPORATING HIGH YIELD FIBER

(75) Inventors: Anthony O. Awofeso, Appleton, WI (US); Kang C. Yeh, Neenah, WI (US); Ronald R. Reeb, De Pere, WI (US); Henry Chou, Neenah, WI (US); Bruce W. Janda, Neenah, WI (US)

(73) Assignee: Georgia - Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/587,751

(22) Filed: Oct. 13, 2009

(65) Prior Publication Data

US 2010/0032113 A1 Feb. 11, 2010

Related U.S. Application Data

(62) Division of application No. 10/405,874, filed on Apr. 2, 2003, now Pat. No. 7,622,020.

(60) Provisional application No. 60/374,705, filed on Apr. 23, 2002.

(51) Int. Cl.

| | |
|---|---|
| ***B31F 1/12*** | (2006.01) |
| ***D21H 11/08*** | (2006.01) |
| ***D21H 11/10*** | (2006.01) |
| ***D21H 11/14*** | (2006.01) |

(52) U.S. Cl. ..... 162/111; 162/142; 162/147; 162/149

(58) Field of Classification Search ..... 162/109, 162/111–113, 117, 141–142, 147, 149, 204–205; 428/153, 156; 156/209, 219; 264/282–283
See application file for complete search history.

(56) References Cited

U.S. PATENT DOCUMENTS

| | | | |
|---|---|---|---|
| 3,432,936 | A | 3/1969 | Cole et al. |
| 3,994,771 | A | 11/1976 | Morgan, Jr. et al. |
| 4,102,737 | A | 7/1978 | Morton et al. |
| 4,120,747 | A | 10/1978 | Sarge, III et al. |
| 4,529,480 | A | 7/1985 | Trokhan |
| 5,510,002 | A | 4/1996 | Hermans et al. |
| 5,607,551 | A | 3/1997 | Farrington, Jr. et al. |
| 5,690,788 | A | 11/1997 | Marinack et al. |

(Continued)

FOREIGN PATENT DOCUMENTS

| | | |
|---|---|---|
| EP | 0 475 671 A2 | 3/1992 |

(Continued)

*Primary Examiner*—José A Fortuna
(74) *Attorney, Agent, or Firm*—Michael W. Ferrell

(57) ABSTRACT

An absorbent sheet of cellulosic fiber typically includes at least about 15% by weight of high coarseness, generally tubular and lignin-rich cellulosic fiber based on the combined weight of cellulosic fiber in the sheet. Lignin-rich high coarseness, generally tubular fiber employed may be characterized by a coarseness of at least about 20 mg/100 m and an average length of 2 mm. The sheet is prepared by way of a process including applying a dewatered web to a heated rotating cylinder and creping the web from the heated cylinder with an undulatory creping blade. Preferred lignin-rich, high coarseness, generally tubular fibers include thermo and chemi mechanical pulps. A particularly preferred embodiment is a sheet including at least about 15% BCTMP.

20 Claims, 16 Drawing Sheets

U.S. PATENT DOCUMENTS

| | | | | |
|---|---|---|---|---|
| 5,891,309 | A | 4/1999 | Page et al. | |
| 6,074,527 | A | 6/2000 | Hsu et al. | |
| 6,254,725 | B1 | 7/2001 | Lau et al. | |
| 7,622,020 | B2 * | 11/2009 | Awofeso et al. | 162/111 |
| 2003/0131959 | A1 * | 7/2003 | Marinack et al. | 162/111 |
| 2003/0196772 | A1 * | 10/2003 | Awofeso et al. | 162/111 |

FOREIGN PATENT DOCUMENTS

| | | | |
|---|---|---|---|
| EP | 0 707 934 | A2 | 4/1996 |
| EP | 0 806 521 | A2 | 11/1997 |
| EP | 1157818 | A1 * | 11/2001 |
| EP | 1356923 | A1 * | 10/2003 |
| WO | WO 01/48314 | A2 | 7/2001 |

* cited by examiner

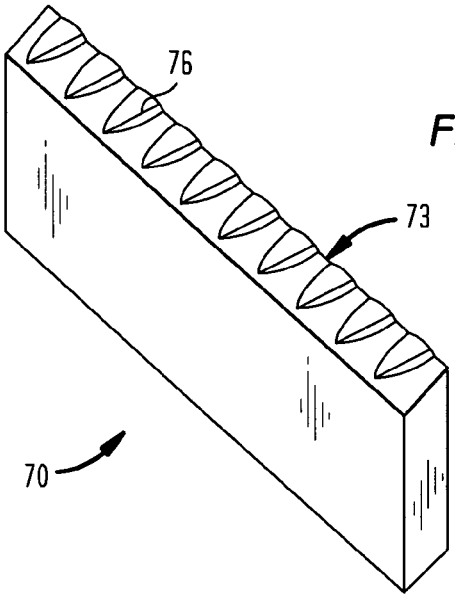
FIG. 3A
FIG. 3B
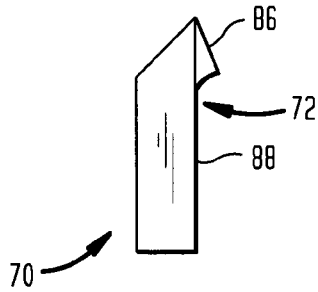
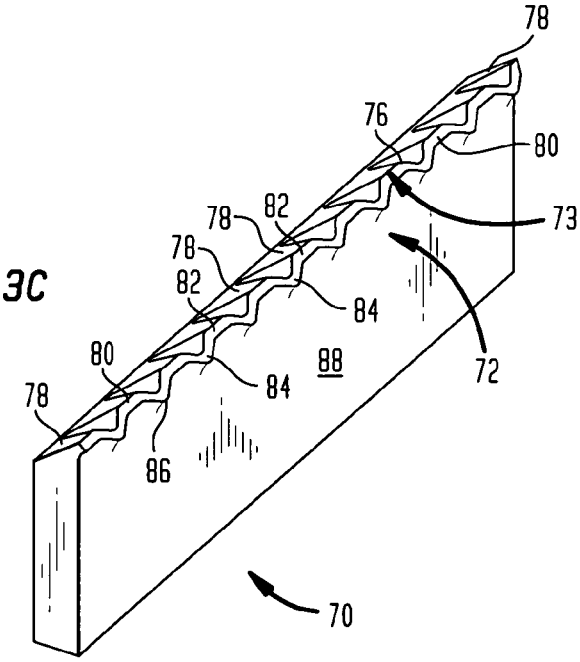
FIG. 3C
FIG. 3D
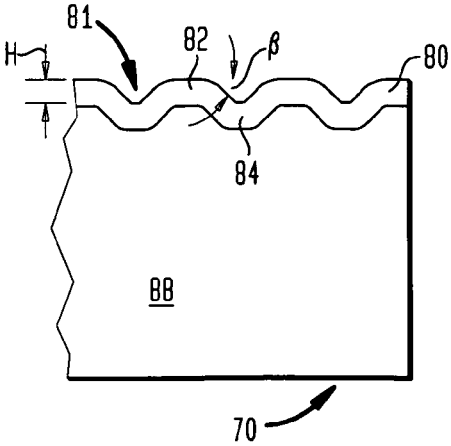

0% BCTMP

40% BCTMP

Mag :x400
Acc.V :20kV
Signal :SEI
WD :18mm
Spot size :30
Pressure : μ
----------:50 m Mag :x400
Acc.V :20kV
Signal :SEI
WD :20mm
Spot size :30
Pressure : μ
----------:50 m

METHOD OF MAKING CREPED TOWEL AND TISSUE INCORPORATING HIGH YIELD FIBER

CLAIM FOR PRIORITY

This application is a divisional of U.S. patent application Ser. No. 10/405,874, entitled "Creped Towel And Tissue Incorporating High Yield Fiber", filed Apr. 2, 2003, now U.S. Pat. No. 7,622,020. U.S. patent application Ser. No. 10/405,874 claims the benefit of the filing date of U.S. Provisional Patent Application Ser. No. 60/374,705, of the same title, filed Apr. 23, 2002. The priorities of U.S. patent application Ser. No. 10/405,874 and U.S. Provisional Patent Application Ser. No. 60/374,705 are hereby claimed and their disclosures are incorporated herein by reference in their entireties.

TECHNICAL FIELD

The present invention relates generally to creped towel and tissue products prepared with an undulatory creping blade and including tubular, high coarseness fibers such as lignin-rich, high yield fibers. In a preferred embodiment, the products are made from furnish incorporating at least about 15% BCTMP.

BACKGROUND

The use of recycled cellulosic furnish to make towel and tissue products is increasingly desirable in view of the rising costs of virgin fibers, especially for facilities which use large volumes of absorbent products. Products made from recycle furnish tend to be relatively stiff, having relatively high tensiles and relatively low bulk leading to poor absorbency and properties. Moreover, these products tend to have relatively low wet/dry strength ratios. Various methods have been employed to increase the bulk and softness of products made from recycle furnish, including the use of softeners, debonders and the like as well as anfractuous fibers and/or new processing techniques; some of which require significant capital investment and cannot be readily adapted to existing production capacity such as conventional wet-press paper machines with Yankee dryers.

There is disclosed in U.S. Pat. No. 5,607,551 to Farrington, Jr. et al. throughdried tissues made without the use of a Yankee dryer. The typical Yankee functions of building machine direction and cross-machine direction stretch are replaced by a wet end rush transfer and the throughdrying fabric design, respectively. According to the '551 patent it is particularly advantageous to form the tissue with chemi-mechanically treated fibers in at least one layer. Resulting tissues are reported to have high bulk and low stiffness. Furnishes enumerated in connection with the Farrington, Jr. et al. process include virgin softwood, hardwood as well as secondary or recycle fibers. Col. 4, lines 28-31. In the '551 patent it is further taught to incorporate high-lignin content fibers such as groundwood, thermomechanical pulp, chemimechanical pulp, and bleached chemithermomechanical pulp. Generally these pulps have lignin contents of about 15 percent or greater, whereas chemical pulps (Kraft and sulfite) are low yield pulps have a lignin content of about 5 percent or less. The high-lignin fibers are subjected to a dispersing treatment in a disperser in order to introduce curl into the fibers. The temperature of the fiber suspension during dispersion can be about 140° F. or greater, preferably about 150° F. or greater and preferably about 210° F. or greater. The upper limit on the temperature is dictated by whether or not the apparatus is pressurized, since the aqueous fiber suspensions within an apparatus operating at atmosphere cannot be heated above the boiling point of water. Interestingly, it is believed that the degree of permanency of the curl is greatly impacted by the amount of lignin in the fibers being subjected to the dispersing process, with greater effects being attainable for fibers having higher lignin content. Col. 5, lines 43 and following. Lignin-rich, high coarseness, generally tubular fibers are further described in U.S. Pat. No. 6,254,725 of Lau et al. as well as U.S. Pat. No. 6,074,527 of Hsu et al. See also U.S. Pat. Nos. 6,287,422; 6,162,961; 5,932,068; 5,772,845; 5,656,132. The so-called uncreped, through-dried process of the '551 patent requires a relatively high capital investment and is expensive to operate inasmuch as thermal dewatering of the web is energy intensive and is sensitive to fiber composition.

Considerable commercial success has also been achieved in connection with U.S. Pat. No. 5,690,788 to Marinack et al. In accordance with the '788 patent there is provided biaxially undulatory single ply and multiply tissues, single ply and multiply towels, single ply and multiply napkins and other personal care and cleaning products as well as novel creping blades and novel processes for the manufacture for such paper products. Generally speaking, there is provided in accordance with the '788 patent a creping blade provided with an undulatory rake surface having trough-shape serrulations in the rake surface of the blade. The undulatory creping blade has a multiplicity of alternating serrulated sections of either uniform depth or a multiplicity of arrays of serrulations having non-uniform depth. The blade is operative to impart a biaxially undulatory structure to the creped web such that the product exhibits increased absorbency and softness with a variety of furnishes. Specifically disclosed are conventional furnishes such as softwood, hardwood, recycle, mechanical pulps, including thermo-mechanical and chemithermomechanical pulp, anfractuous fibers and combinations of these. Col. 20, line 41 and following. There is noted in example 20 of the '788 patent the improved properties obtained when using the undulatory blade in the manufacture of towels including up to 30 percent anfractuous fiber (HBA). The high bulk additive (HBA) is a commercially available softwood Kraft pulp sold by Weyerhauser Corporation that has been rendered anfractuous by physically and chemically treating the pulp such that the fibers have permanent kinks and curls imparted to them. Inclusion of the HBA fibers into the base sheet will serve to improve the sheet's bulk and absorbency. A significant advantage of the invention of the '788 patent over other advanced processing techniques is that it can be implemented with relatively low capital investment, and is compatible with processes employing mechanical dewatering.

The disclosure of the foregoing references incorporated herein by reference.

Despite many advances in the art, there is an ever present need for further improvements to products which incorporate cellulosic fiber such as recycle fiber, especially those improvements which do so on a cost-effective basis in terms of required capital and operating costs. It has been found in accordance with the present invention that there is a surprising synergy between the use of an undulatory creping blade and the incorporation of certain high yield fibers into the web as described hereinafter.

SUMMARY OF INVENTION

In one aspect of the present invention, there is provided a creped absorbent cellulosic sheet incorporating high coarseness, generally tubular and lignin-rich fiber prepared by way of a process including applying a dewatered web to a heated rotating cylinder and creping the web from said heated rotating cylinder with an undulatory creping blade, wherein the fiber content of the creped cellulosic sheet is at least about 15% by weight lignin-rich, high coarseness and generally tubular fiber based on the weight of cellulosic fiber in said sheet wherein said lignin-rich, high coarseness and generally tubular fiber has an average fiber length of at least about 2 mm (millimeters) and a coarseness of at least about 20 mg/100 m. Typically, the high coarseness, generally tubular, lignin-rich fibers have an average length of from about 2.2 to about 3 mm.

Suitable high coarseness, generally tubular lignin-rich fibers include thermomechanical pulp (TMP), chemithermomechanical pulp (CTMP) as well as bleached chemithermomechanical pulps (BCTMP). Alkaline peroxide mechanical pulps, sometimes referred to "APMP" or simply "AMP" may likewise be utilized in accordance with the present invention. Lignin-rich pulps generally have a lignin content of more than 5% based on the weight of the pulp; typically more than 10 percent and suitably about 20 percent or more lignin content by weight. Throughout this specification and claims, when we refer to average fiber length, we are referring to weight average fiber length as further discussed below.

An especially preferred product of the invention is an absorbent cellulosic sheet consisting predominantly of recycle cellulosic fiber incorporating at least about 15% by weight of a lignin-rich, coarse and generally tubular fiber prepared by way of a process comprising applying a dewatered web to a heated rotating cylinder and creping said web from said heated rotating cylinder with an undulatory creping blade.

The products of the invention may be single ply or multiply products, for example, a two-ply towel may be made in accordance with the invention. The product may be made by way of a dry-crepe process where the consistency upon creping is about 95 percent or so or by way of a wet-crepe process as further discussed herein.

A wet-crepe process for making absorbent sheet of the invention includes the steps of: (a) preparing an aqueous cellulosic fibrous furnish wherein at least about 15% by weight of the fiber based on the weight of cellulosic fiber in the furnish is lignin-rich coarse fiber having a generally tubular fiber configuration as well as an average fiber length of at least about 2 mm and a coarseness of at least about 20 mg/100 m; (b) depositing the aqueous fibrous furnish on a foraminous support; (c) dewatering the furnish to form a web; (d) applying the dewatered web to a heated rotating cylinder and drying the web to a consistency of greater than about 30% and less than about 90%; (e) creping the web from the heated cylinder at the consistency of greater than about 30% and less than about 90% with a creping blade provided with an undulatory creping surface adapted to contact the cylinder; and (f) drying the web subsequent to creping the web from the heated cylinder to form the absorbent sheet. In preferred embodiments, the water absorbent capacity (WAC) of the sheet of the present invention is at least about 5% greater than that of a like or equivalent sheet prepared without the use of an undulatory creping blade or at least 5% more than that of a sheet made without high coarseness tubular fibers creped with an equivalent undulatory blade. Likewise, the caliper of the sheet of the invention is most preferably at least about 7.5% greater than that of a like or equivalent sheet prepared without the use of an undulatory creping blade or at least about 5% more than that of a sheet made without high coarseness tubular fibers creped with an equivalent undulatory creping blade. Even more striking differences may be observed in WAR (water absorbency rate as defined hereinbelow) times, which decrease dramatically in preferred embodiments. The WAR time (sec) of the sheet of the present invention may be at least 10% less than that of a like or equivalent sheet prepared without the use of an undulatory creping blade or at least about 10% less than that of a like or equivalent sheet made without high coarseness, tubular fibers. These differences are particularly apparent from FIGS. 8, 9 and 10 discussed hereafter.

A dry-crepe process for making absorbent sheet of the invention includes: (a) preparing an aqueous cellulosic fibrous furnish wherein at least about 15% by weight of the fiber based on the weight of cellulosic fiber in the furnish is lignin-rich coarse fiber having a generally tubular fiber configuration as well as an average fiber length of at least about 2 mm and a coarseness of at least about 20 mg/100 m; (b) depositing the aqueous fibrous furnish on a foraminous support; (c) dewatering the furnish to form a web; (d) applying the dewatered web to a heated rotating cylinder and drying the web to a consistency of about 90% or greater; and (e) creping the web from the heated cylinder at the consistency of about 90% or more with a creping blade provided with an undulatory creping surface adapted to contact the cylinder. By way of this process, the sheet also is preferably provided with increased WAC values, caliper and reduced WAR time as noted above.

The foregoing as well as further aspects and advantages of the present invention are described in detail hereinafter.

BRIEF DESCRIPTION OF DRAWINGS

The present invention is described in detail below with reference to the various Figures wherein like numerals designate similar parts and wherein:

FIGS. 3A-3D are schematic diagrams illustrating the geometry of an undulatory creping blade utilized in accordance with the present invention;

DETAILED DESCRIPTION

Figure 1:
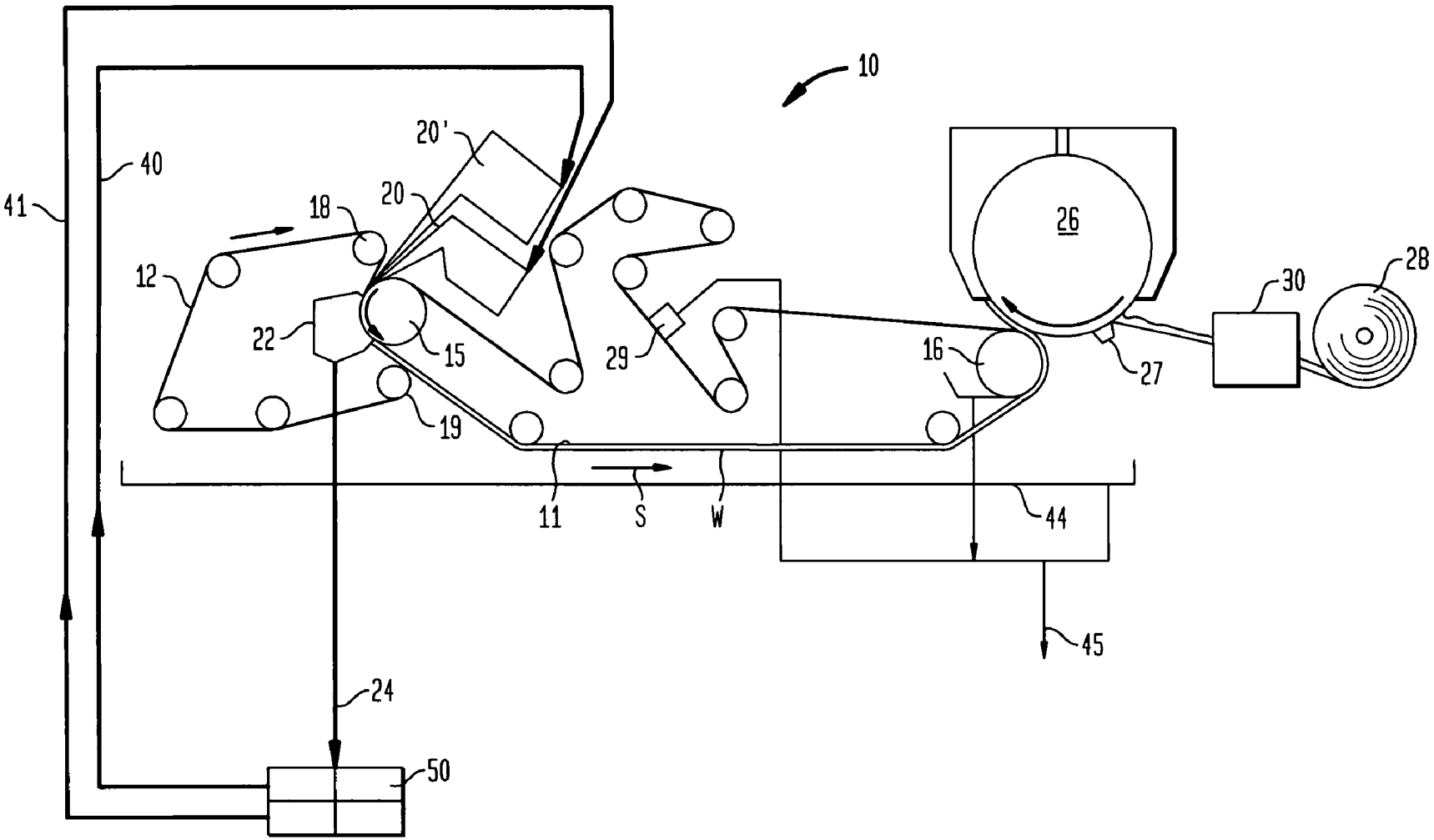
FIG. 1 is a schematic diagram of a papermaking machine useful for the practice of the present invention.

The invention is described in detail below for purposes of description and exemplification only. Modifications within the spirit and scope of the present invention, set forth in the appended claims, will be readily apparent to those of skill in the art.

In general, the invention is directed to a creped absorbent cellulosic sheet incorporating from about 15% to about 40% by weight of high coarseness, generally tubular and lignin-rich cellulosic fiber based on the weight of cellulosic fiber in the sheet prepared by way of a process comprising applying a dewatered web to a heated rotating cylinder and creping the web from the heated rotating cylinder with an undulatory creping blade. When a lignin-rich, high coarseness and generally tubular cellulosic fiber is used, it typically comprises at least about 10% by weight lignin based on the weight of the lignin-rich cellulosic fiber, and preferably at least about 15% by weight lignin based on the weight of the lignin-rich cellulosic fiber. In preferred embodiments, the lignin-rich, high coarseness generally tubular fiber comprises from about 15% to about 25% by weight lignin based on the weight of the lignin-rich, high coarseness and generally tubular cellulosic fiber in the sheet. The lignin-rich, high coarseness and generally tubular fiber typically has an average fiber length of at least about 2.25 mm and usually from about 2.25 to about 2.75 mm as well as a coarseness of from about 20-30 mg/100 m.

Suitable lignin-rich, high coarseness and generally tubular cellulosic fibers include fibers selected from the group consisting of: APMP, TMP, CTMP, BCTMP, and mixtures thereof; as defined herein. The sheet may be an embossed absorbent sheet, and in some embodiments a perforate embossed sheet. These fibers are typically present from about 20 to about 40 percent by weight. BCTMP is a particularly suitable fiber for many products and may have a lignin content of at least 15%, at least 20% or at least 25% by weight. BTCMP with a lignin content of 25-35% may be employed.

The high coarseness and generally tubular lignin-rich fiber is derived from softwood in many preferred embodiments and may be APMP, TMP, CTMP or BCTMP.

The sheet may be embossed with a plurality of oval patterns having their major axes generally along the cross-direction of the sheet, and may be a one-ply, wet-creped towel having a basis weight of from about 18 or 20 to about 35 pounds per 3000 square foot ream. The emboss may be a perforate emboss if so desired. CD wet tensile strength of greater than about 500 g/3", preferably greater than about 700 g/3", and a WAC of greater than about 170 g/m$^2$ is typical for these products. Preferably, the sheet has a wet/dry CD tensile ratio of at least about 20%, and more preferably at least about 25% or 30%. Preferably the water absorbency rate (WAR) is less than about 25 seconds, and more preferably less than about 15 seconds.

Preferred embossed products include perforate embossed products with a transluminance ratio (hereinafter defined) of at least about 1.005. A dry MD/CD tensile ratio of less than about 2 and more preferably less than about 1.5 is preferred.

The sheet is characterized by a biaxially undulatory reticulate structure with from about 4 to about 50 ridges per inch in the machine direction and from about 8 to about 150 crepe bars per inch in the cross-direction. From about 8 to about 20 ridges per inch in the machine direction is typical.

The sheet may be prepared by way of a wet-crepe process for making absorbent sheet comprising the steps of: a) preparing an aqueous fibrous cellulosic furnish comprising high coarseness, generally tubular and preferably lignin-rich cellulosic fiber; b) depositing the aqueous fibrous furnish on a foraminous support; c) dewatering the furnish to form a web; d) applying the dewatered web to a heated rotating cylinder and drying the web to a consistency of greater than about 30% and less than about 90%; e) creping the web from the heated cylinder at the consistency of greater than about 30% and less than about 90% with a creping blade provided with an undulatory creping surface adapted to contact the cylinder; and f) drying the web subsequent to creping the web from the heated cylinder to form the absorbent sheet. Typically, the web is dried to a consistency of from about 40 to about 80% prior to creping the web from the heated rotating cylinder; and preferably the web is dried to a consistency of greater than about 50% and less than about 75% prior to creping from the heated rotating cylinder. The creping blade is advantageously provided with from about 4 to about 50 teeth per inch, and typically is provided with from about 8 to about 20 teeth per inch in most cases. The blade has a tooth depth of from about 5 to about 50 mils generally and a tooth depth of from about 15 to about 40 mils typically. A tooth depth of from about 25 to about 35 mils is preferred in some embodiments.

Another process which may be employed is a dry-crepe process which does not require an after-crepe dryer. In such a process, the web is dried to a consistency of greater than about 90%, preferably greater than about 95% on a Yankee dryer prior to creping.

A particularly preferred product is predominantly recycle fiber (more than 50% by weight based on the weight of cellulosic fiber in the sheet) with at least about 15% by weight high yield, lignin-rich cellulosic fiber. At least about 60%, 75% or 80% recycle fiber may be incorporated into the sheet if so desired. Specific features and embodiments of the invention are further described below.

Test Methods, Fibers and Definitions

Unless otherwise indicated, the following test methods, material descriptions and definitions are used throughout.

Water Absorbent Capacity (WAC)

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm diameter conduit. This water is at a hydrostatic head of minus 5 mm. Flow is initiated by a pulse introduced at the start of the measurement by the instrument mechanism.

Water is thus imbibed by the tissue, napkin, or towel sample from this central entrance point radially outward by capillary action.

When the rate of water imbibition decreases below 0.005 gm water per 5 seconds, the test is terminated. The amount of water removed from the reservoir and absorbed by the sample is weighed and reported as grams of water per square meter of sample.

In practice, an M/K Systems Inc. Gravimetric Absorbency Testing System is used. This is a commercial system obtainable from M/K Systems Inc., 12 Garden Street, Danvers, Mass., 01923. WAC or water absorbent capacity is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria.

Water Absorbency Rate (WAR)

Water absorbency rate or WAR, is measured in seconds and is the time it takes for a sample to absorb a 0.1 gram droplet of water disposed on its surface by way of an automated syringe. The test specimens are preferably conditioned at 23° C.±1° C. (73.4±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample.

Dry Tensile

Dry tensile strengths (MD and CD) are measured with a standard Instron test device which may be configured in various ways, using 3-inch wide strips of tissue or towel, conditioned at 50% relative humidity and 23° C. (73.4), with the tensile test run at a crosshead speed of 2 in/min. Tensiles are sometimes reported herein in breaking length (BL, km).

Wet Tensile

Following generally the procedure for dry tensile, wet tensile is measured by first drying the specimens at 100° C. or so and then applying a 1½ inch band of water across the width of the sample with a Payne Sponge Device prior to tensile measurement. Alternatively, methods using a Finch cup can also be informative.

Wet/dry tensile ratios are simply ratios of the values determined by way of the foregoing methods.

Void Volume Ratio

The "void volume ratio" as referred to hereafter, is determined by saturating a sheet with a nonpolar liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereinafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL™ liquid having a specific gravity of 1.875 grams per cubic centimeter, available from Coulter Electronics Ltd., Northwell Drive, Luton, Beds, England; Part No. 9902458.) After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL per gram of fiber, is calculated as follows:

$$PWI=[(W_2-W_1)/W_1]\times 100\%$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage.

Lignin Content

Lignin content is measured by way of TAPPI method T222-98 (acid insoluble lignin). In this method, the carbohydrates in wood and pulp are hydrolyzed and solubilized by sulfuric acid; the acid-insoluble lignin is filtered off, dried and weighed.

Fiber Length, Coarseness

Fiber length and coarseness can be measured using a fiber-measuring instrument such as the Kajaani FS-200 analyzer available from Valmet Automation of Norcross, Ga. or an OPTEST FQA. For fiber length measurements, a dilute suspension of the fibers (approximately 0.5 to 0.6 percent) whose length is to be measured may be prepared in a sample beaker and the instrument operated according to the procedures recommended by the manufacturer. The report range for fiber lengths is set at an instrument's minimum value of, for example, 0.07 mm and a maximum value of, for example, 7.2 mm; fibers having lengths outside of the selected range are excluded. Three calculated average fiber lengths may be reported. The arithmetic average length is the sum of the product of the number of fibers measured and the length of the fiber divided by the sum of the number of fibers measured. The length-weighted average fiber length is defined as the sum of the product of the number of fibers measured and the length of each fiber squared divided by the sum of the product of the number of fibers measured and the length the fiber. The weight-weighted average fiber length is defined as the sum of the product of the number of fibers measured and the length of the fiber cubed divided by the sum of the product of the number of fibers and the length of the fiber squared. As used herein throughout the specification and claims, the weight weighted average fiber length is referred to by the terminology "average fiber length", fiber length and so forth.

Fiber coarseness is the weight of fibers in a sample per a given length and is usually reported as mg/100 meters. The fiber coarseness of a sample is measured from a pulp or paper sample that has been dried and then conditioned at, for example, 72 degrees Fahrenheit and 50% relative humidity for at least four hours. The fibers used in the coarseness measurement are removed from the sample using tweezers to avoid contamination. The weight of fiber that is chosen for the coarseness determination depends on the estimated fraction of hardwood and softwood in the sample and range from 3 mg for an all-hardwood sample to 14 mg for a sample composed entirely of softwood. The portion of the sample to be used in the coarseness measurement is weighed to the nearest 0.00001 gram and is then slurried in water. To insure that a uniform fiber suspension is obtained and that all fiber clumps are dispersed, an instrument such as the Soniprep 150, available from Sanyo Gallenkamp of Uxbridge, Middlesex, UK, may be used to disperse the fiber. After dispersion, the fiber sample is transferred to a sample cup, taking care to insure that the entire sample is transferred. The cup is then placed in the fiber analyzer as noted above. The dry weight of pulp used in the measurement, which is calculated by multiplying the weight obtained above by 0.93 to compensate for the moisture in the fiber, is entered into the analyzer and the coarseness is determined using the procedure recommended by the manufacturer.

Caliper

Calipers reported herein are 8 sheet calipers unless otherwise indicated. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. Select and stack eight sheets together. For napkin testing, completely unfold napkins prior to stacking. For base sheet testing off of winders, each sheet to be tested must have the same number of plies as produced off the winder. Select and stack eight sheets together. For base sheet testing off of the paper machine reel, single plies must be used. Select and stack eight sheets together.

On custom embossed or printed product, try to avoid taking measurements in these areas if at all possible.

Transluminance

A perforated embossed web that is positioned over a light source will exhibit pinpoints of light in transmission when viewed at a low angle and from certain directions. The direction from which the sample must be viewed, e.g., machine direction or cross-machine direction, in order to see the light, is dependent upon the orientation of the embossing elements. Machine direction oriented embossing elements tend to generate ruptures which are longer in the machine direction in the web which can be primarily seen when viewing the web in the cross-machine direction. Cross-machine direction oriented embossing elements, on the other hand, tend to generate cross-machine direction ruptures in the web which can be seen primarily when viewing the web in the machine direction. The transluminance test apparatus consists of a piece of cylindrical tube that is approximately 8.5" long and cut at a 28° angle. The inside surface of the tube is painted flat black to minimize the reflection noise in the readings. Light transmitted through the web itself, and not through a rupture, is an example of a non-target light source that could contribute to translucency noise which could lead non-perforate embossed webs to have transluminance ratios slightly exceeding 1.0, but typically by no more than about 0.05 points. A detector, attached to the non-angled end of the pipe, measures the transluminance of the sample. The light table, having a translucent glass surface is the light source.

The test is performed by placing the sample in the desired orientation on the light table. The detector is placed on top of the sample with the long axis of the tube aligned with the axis of the sample, either the machine direction or cross-machine direction, that is being measured and the reading on a digital illuminometer is recorded. The sample is turned 90° and the procedure is repeated. This is done two more times until all four views, two in the machine direction and two in the cross-machine direction, are measured. In order to reduce variability, all four measurements are taken on the same area of the sample and the sample is always placed in the same location on the light table. To evaluate the transluminance ratio, the two machine direction readings are summed and divided by the sum of the two cross-machine direction readings.

A transluminance ratio of greater than 1.000 indicates that the majority of the perforations are in the cross-machine direction. For embossing rolls having cross-machine direction elements, the majority of the perforations are in the cross-machine direction. And, for the machine direction perforated webs, the majority of the perforations are in the machine direction. Thus, the transluminance ratio can provide a ready method of indicating the predominant orientation of the perforations in a web.

Fibers

The terms "fibrous", "furnish", "aqueous furnish" and the like include all paper absorbent sheet-forming furnishes and fibers. The term "cellulosic" is meant to include any papermaking fiber having cellulose as a major constituent. "Papermaking fibers" include virgin pulps or recycle cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen and so forth.

As described hereinabove, the products of the present invention comprise a blend of conventional fibers (whether derived from virgin pulp or recycle sources) and high coarseness lignin-rich tubular fibers.

Conventional fibers for use according to the present invention are also procured by recycling of pre- and post-consumer paper products. Fiber may be obtained, for example, from the recycling of printers' trims and cuttings, including book and clay coated paper, post consumer paper including office and curbside paper recycling including old newspaper. The various collected paper can be recycled using means common to the recycled paper industry. As the term is used herein, recycle or secondary fibers include those fibers and pulps which have been formed into a web and reisolated from its web matrix by some physical, chemical or mechanical means. The papers may be sorted and graded prior to pulping in conventional low, mid, and high-consistency pulpers. In the pulpers the papers are mixed with water and agitated to break the fibers free from the sheet. Chemicals may be added in this process to improve the dispersion of the fibers in the slurry and to improve the reduction of contaminants that may be present. Following pulping, the slurry is usually passed through various sizes and types of screens and cleaners to remove the larger solid contaminants while retaining the fibers. It is during this process that such waste contaminants as paper clips and plastic residuals are removed. The pulp is then generally washed to remove smaller sized contaminants consisting primarily of inks, dyes, fines and ash. This process is generally referred to as deinking. Deinking can be accomplished by several different processes including wash deinking, flotation deinking, enzymatic deinking and so forth. One example of a sometimes preferred deinking process by which recycled fiber for use in the present invention can be obtained is called floatation. In this process small air bubbles are introduced into a column of the furnish. As the bubbles rise they tend to attract small particles of dye and ash. Once upon the surface of the column of stock they are skimmed off.

The preferred conventional fibers according to the present invention may consist predominantly of secondary or recycle fibers that possess significant amounts of ash and fines. It is common in the industry to hear the term ash associated with virgin fibers. This is defined as the amount of ash that would be created if the fibers were burned. Typically no more than about 0.1% to about 0.2% ash is found in virgin fibers. Ash, as the term is used here, includes this "ash" associated with virgin fibers as well as contaminants resulting from prior use of the fiber. Furnishes utilized in connection with the present invention may include excess of amounts of ash greater than about 1% or more. Ash originates primarily when fillers or coatings are added to paper during formation of a filled or coated paper product. Ash will typically be a mixture containing titanium dioxide, kaolin clay, calcium carbonate and/or silica. This excess ash or particulate matter is what has traditionally interfered with processes using recycle fibers, thus making the use of recycled fibers unattractive. In general recycled paper containing high amounts of ash is priced substantially lower than recycled papers with low or insignificant ash contents. Thus, there will be a significant advantage to a process for making a premium or near-premium product from recycled paper containing excessive amounts of ash.

Furnishes containing excessive ash also typically contain significant amounts of fines. Ash and fines are most often associated with secondary, recycled fibers, post-consumer paper and converting broke from printing plants and the like. Secondary, recycled fibers with excessive amounts of ash and significant fines are available on the market and are quite cheap because it is generally accepted that only very thin, rough, economy towel and tissue products can be made unless the furnish is processed to remove the ash and fines. The present invention makes it possible to achieve a paper product with high void volume and premium or near-premium qualities from secondary fibers having significant amounts of ash and fines without any need to preprocess the fiber to remove fines and ash. While the present invention contemplates the use of fiber mixtures, including the use of virgin fibers, fiber in the products according to the present invention may have greater than 0.75% ash, and sometimes more than 1% ash.

"Fines" constitute material within the furnish that will pass through a 100 mesh screen. Ash content can be determined using TAPPI Standard Method T211 OM93.

Lignin-rich cellulosic pulps or fibers having high coarseness and generally tubular structure used in the products and processes of the present invention are typically those known in the industry as "high-yield" pulps due to their high yield based on the cellulosic feed to the respective pulping and/or treatment processes. Thermomechanical pulp (TMP), chemithermomechanical pulp (CTMP) as well as bleached chemithermomechanical pulp (BCTMP) and alkaline peroxide mechanical pulp (APMP) are preferably suitable. Such pulps generally have a lignin content of at least about 5% and usually more than about 10% and typically more than about 15% up to about 30% or more. Especially preferred in some embodiments are TMP, CTMP, BCTMP and APMP having lignin contents of from about 15% up to about 25%. Thermomechanical pulp TMP, is a mechanical pulp produced from wood chips where the wood particles are softened by preheating in a pressurized vessel at temperatures not exceeding the glass transition temperature of lignin before a pressurized primary refining stage. Chemithermomechanical, CTMP, pulp is produced from chemically impregnated wood chips by means of pressurized refining at high consistencies. Bleached chemithermomechanical pulp, BCTMP is CTMP bleached to a higher brightness, typically 80+GE. Alkaline peroxide mechanical pulp is produced by way of a chemimechanical pulping process, where the chemical impregnation of the wood chips is carried out by alkaline peroxide prior to refining at atmospheric conditions. Differences between BTCMP and recycle fiber can be appreciated by reference to Table 1 below.

Figure 11A:
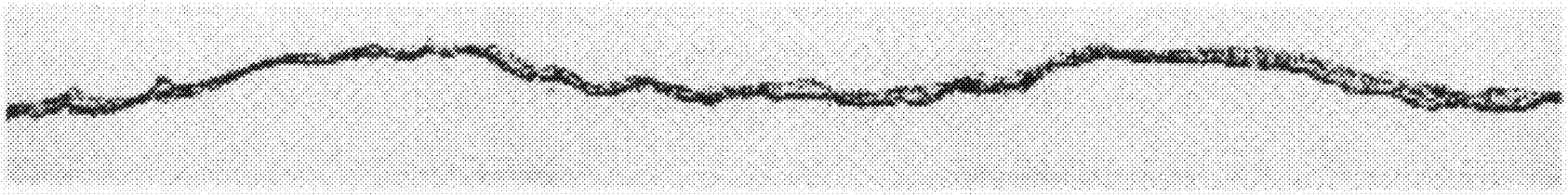
FIG. 11A is a 50× light microscopy sectional photomicrograph showing internal delamination of a creped product without high coarseness, tubular fibers.
Figure 11B:
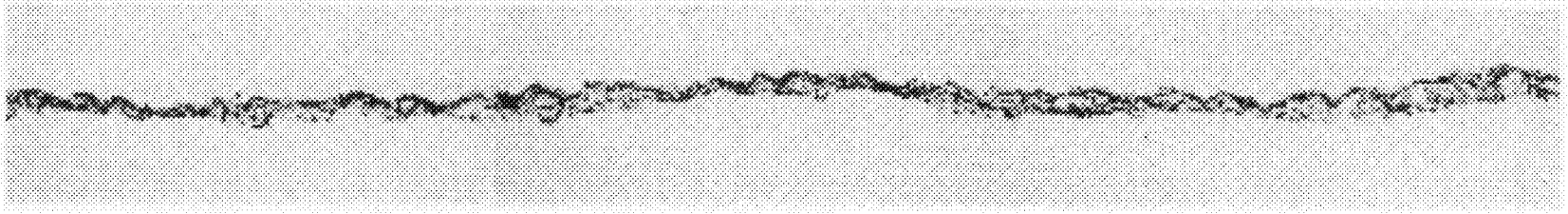
FIG. 11B is a 50× light microscopy sectional photomicrograph showing internal delamination of a creped product containing 40% lignin-rich generally tubular fibers with high coarseness.
Figure 11C:
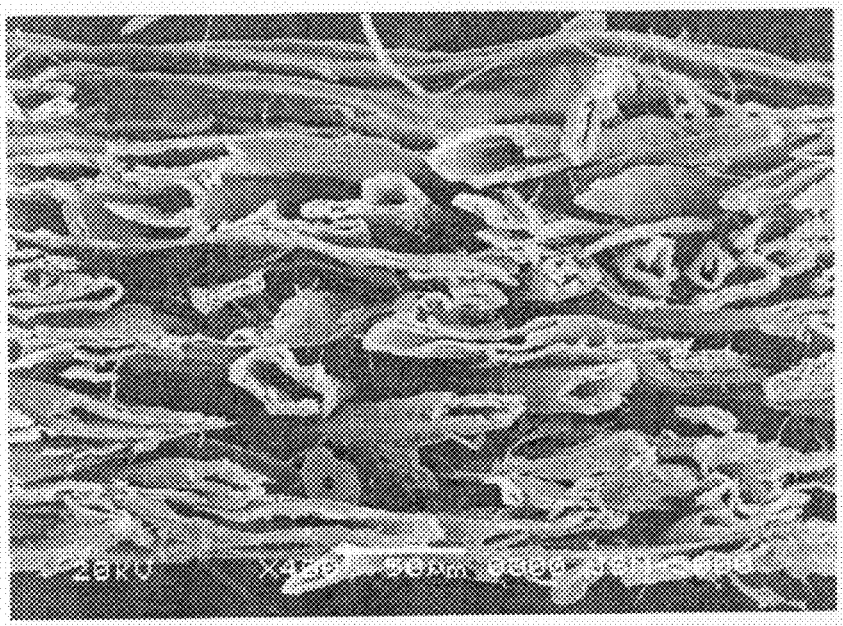
FIG. 11C is a Scanning Electron Micrograph (SEM) (400×) illustrating the generally tubular structure of high coarseness fibers of the present invention when formed into a handsheet.
Figure 11D:
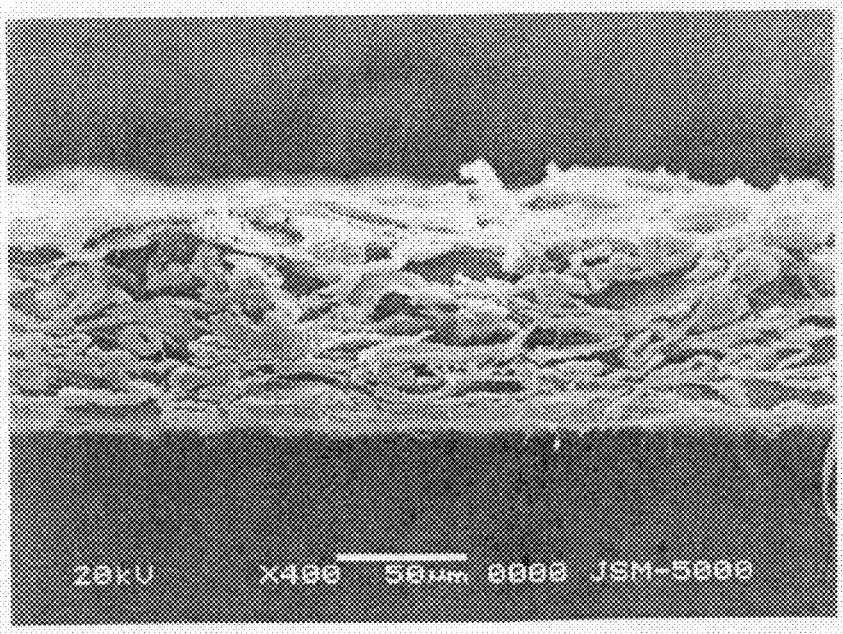
FIG. 11D is a Scanning Electron Micrograph (SEM) (400×) illustrating the generally ribbon-like structure of conventional fibers when formed into a handsheet.

It will also be appreciated from FIGS. 11C and 11D that the high coarseness, generally tubular fibers used in connection with the invention retain their open centered shape of only partially flattened "tubes" in 11C as compared to the ribbon-like or almost fully flattened or closed center configuration of conventional papermaking fibers seen in FIG. 11D. It appears that a few less than completely flattened fibers are present in the photomicrograph of FIG. 11D, but the majority of fibers are truly ribbon-like. In accordance with the present invention, there is provided generally tubular, coarse fiber as seen in FIG. 11C. FIG. 11C is an SEM photomicrograph (400×) of a handsheet made from softwood BCTMP, whereas FIG. 11D is an SEM (400×) of a handsheet made from a conventional pulp.

TABLE 1

Comparison Between BCTMP and Recycle Fiber

| Sample Information Units | Volume ($cm^3$/gm) | Tensile (BL) (km) | Fiber Len. (Weight Average) mm | Coarseness mg/100 m | Mean Curl Lw mm | % Ash |
|---|---|---|---|---|---|---|
| Recycle #1 (High Bright) | 1.55 | 3.41 | 1.94 | 11.70 | 0.09 | 4.99 |
| Recycle #2 (Semi Bleach) | 1.71 | 2.97 | 2.17 | 13.50 | 0.07 | 3.59 |
| Millar Western Softwood BCTMP | 2.70 | 2.78 | 2.50 | 26.50 | 0.03 | 1.42 |
| Millar Western Hardwood BCTMP | 2.41 | 2.04 | 1.23 | 16.50 | 0.03 | 0.84 |

The various high-lignin pulps employed in connection with the present invention may be prepared by any suitable method for example mechanical pulp may be bleached as described in U.S. Pat. No. 6,136,041 to Jaschinski et al. entitled "Method for Bleaching Lignocellulosic Fibers".

Suitable bleached pulps include BCTMP with a 21% lignin content bleached with hydrogen peroxide, sulfite and caustic.

The suspension of fibers or furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines or the like.

As used herein, terminology is given its ordinary meaning unless otherwise defined or the definition of the term is clear from the context. For example, the term percent or % refers to weight percent and the term consistency refers to weight percent of fiber based on dry product unless the context indicates otherwise. Likewise, "ppm" refers to parts by million by weight, and the term "absorbent sheet" refers to tissue or towel made from ligno-cellulosic fiber. "Mils" means thousandths of an inch, m indicates meters, mm millimeters and so forth.

The term "consistency" refers to the weight of solids, typically fiber on a furnish, dry basis. The term "tpi" refers to teeth per inch. "Predominantly" as used herein means more than 50 percent by weight on a dry basis. "MD" refers to the machine direction and "CD" to the cross machine direction.

As used herein, generally, "perforated", "perforate" and like terminology when used in connection with embossed products refers to the existence of either (1) a macro-scale through aperture in the web or (2) when a macro-scale through aperture does not exist, at least incipient tearing such as would increase the transmittivity of light through a small region of the web or would decrease the machine direction strength of a web by at least 15% for a given range of embossing depths. Embossing is commonly used to modify the properties of a web to make a final product produced from that web more appealing to the consumer. For example, embossing a web can improve the softness, absorbency and bulk of the final product. There need not be through-holes created by the embossing process. Embossing can also be used to impart an appealing pattern to a final product. As is well-known, embossing is carried out by passing a web between two or more embossing rolls, at least one of which carries the desired emboss pattern. Known embossing configurations include rigid-to-resilient embossing and rigid-to-rigid embossing. The preferred products of the present invention may further include a perforate embossed web having a plurality of cross-machine direction oriented perforations wherein the embossed web has a dry MD/CD tensile ratio of less than about 1.2. The invention further includes a perforate embossed web having a transluminance ratio (defined above) of at least 1.005. Still further, the invention includes a wet-laid cellulosic perforate embossed web having perforate embossments extending predominately in the cross-machine direction.

Preferred Embodiments

FIG. 1 illustrates an embodiment of the present invention where a machine chest 50, which may be compartmentalized, is used for preparing furnishes that are treated with chemicals having different functionality depending on the character of the various fibers used. This embodiment shows two head boxes thereby making it possible to produce a stratified product. The product according to the present invention can be made with single or multiple head boxes and regardless of the number of head boxes may be stratified or unstratified. The treated furnish is transported through different conduits 40 and 41, where they are delivered to the head box 20, 20' (indicating an optionally compartmented headbox) of a crescent forming machine 10.

FIG. 1 shows a web-forming end or wet end with a liquid permeable foraminous support member 11 which may be of any conventional configuration. Foraminous support member 11 may be constructed of any of several known materials including photopolymer fabric, felt, fabric, or a synthetic filament woven mesh base with a very fine synthetic fiber batt attached to the mesh base. The foraminous support member 11 is supported in a conventional manner on rolls, including breast roll 15 and couch or pressing roll, 16.

Forming fabric 12 is supported on rolls 18 and 19 which are positioned relative to the breast roll 15 for pressing the press wire 12 to converge on the foraminous support member 11. The foraminous support member 11 and the wire 12 move in the same direction and at the same speed which is in the direction of rotation of the breast roll 15. The pressing wire 12 and the foraminous support member 11 converge at an upper surface of the forming roll 15 to form a wedge-shaped space or nip into which one or more jets of water or foamed liquid fiber dispersion (furnish) provided by single or multiple headboxes 20, 20' is pressed between the pressing wire 12 and the foraminous support member 11 to force fluid through the wire 12 into a saveall 22 where it is collected to reuse in the process.

The nascent web W formed in the process is carried by the foraminous support member 11 to the pressing roll 16 where the nascent web W is transferred to the drum 26 of a Yankee dryer. Fluid is pressed from the web W by pressing roll 16 as the web is transferred to the drum 26 of a dryer where it is partially dried and preferably wet-creped by means of an undulatory creping blade 27. The wet-creped web is then transferred to an after-drying section 30 prior to being collected on a take-up roll 28. The drying section 30 may include through-air dryers, impingement dryers, can dryers, another Yankee dryer and the like as is well known in the art and discussed further below.

A pit 44 is provided for collecting water squeezed from the furnish by the press roll 16 and a Uhle box 29. The water collected in pit 44 may be collected into a flow line 45 for separate processing to remove surfactant and fibers from the water and to permit recycling of the water back to the papermaking machine 10.

According to the present invention, an absorbent paper web can be made by dispersing fibers into aqueous slurry and depositing the aqueous slurry onto the forming wire of a papermaking machine. Any suitable forming scheme might be used. For example, an extensive but non-exhaustive list includes a crescent former, a C-wrap twin wire former, an S-wrap twin wire former, a suction breast roll former, a Fourdrinier former, or any art-recognized forming configuration. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025;

5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon wet-creping. Suitable foam-forming techniques are disclosed in U.S. Pat. No. 4,543,156 and Canadian Patent No. 2,053,505, the disclosures of which are incorporated herein by reference.

Figure 2:
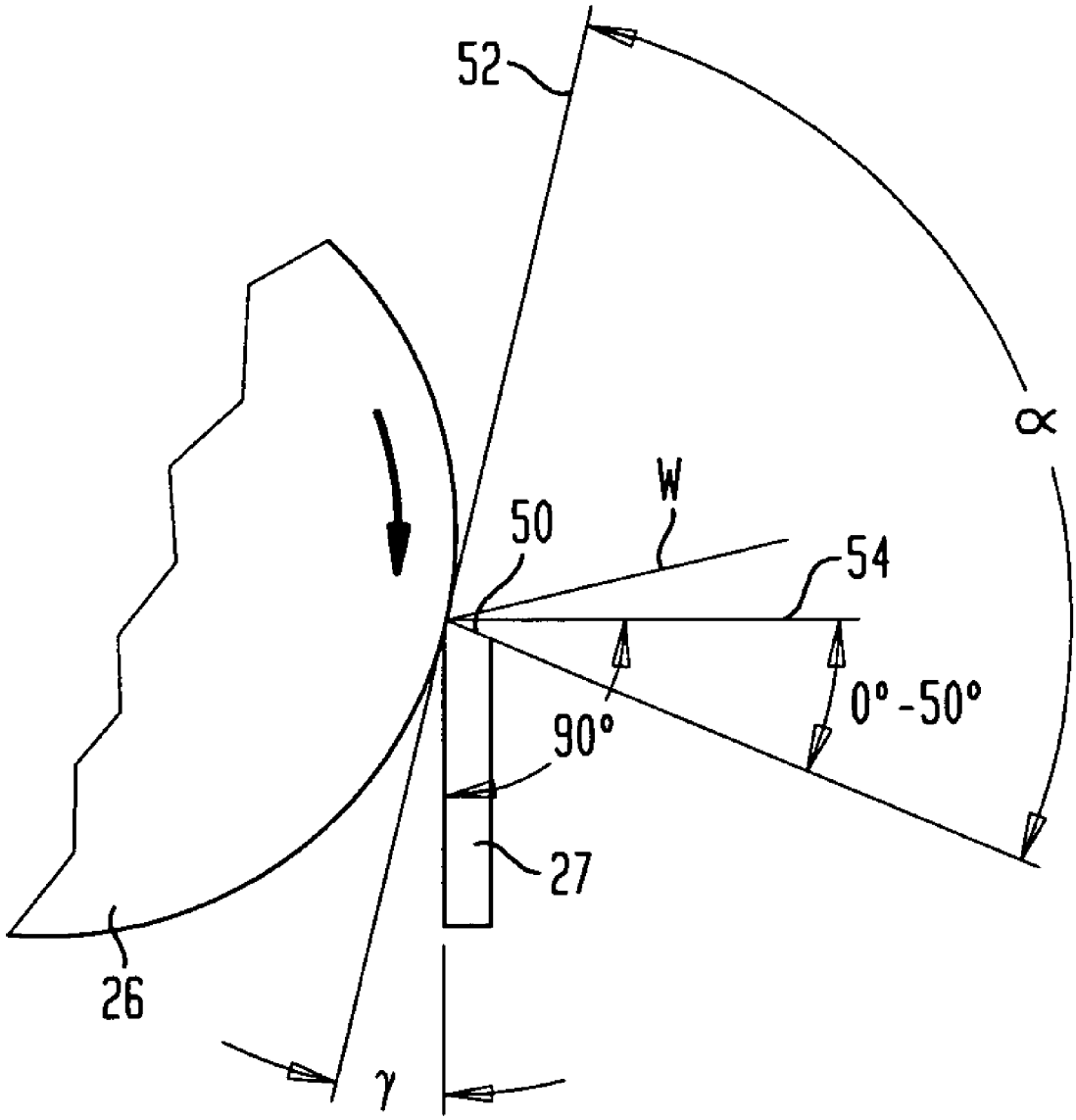
FIG. 2 is a schematic diagram illustrating various characteristic angles of a creping process.

The creping angle and blade geometry may be employed as means to influence the sheet properties. Referring to FIG. 2, the creping angle or pocket angle, $\alpha$, is the angle that the creping rake surface 50 makes with a tangent 52 to a Yankee dryer at the line of contact of the creping blade 27 with the rotating cylinder 26 as in FIG. 1. So also, an angle $\gamma$ is defined as the angle the blade body makes with tangent 52, whereas the bevel angle of creping blade 27 is the angle surface 50 defines with a perpendicular 54 to the blade body as shown in the diagram. Referring to FIG. 2, the creping angle is readily calculated from the formula:

$$\alpha=90+\text{blade bevel angle}-\gamma$$

for a conventional blade. These parameters vary over the creping surface of an undulatory blade as discussed herein.

In accordance with the present invention, creping of the paper from a Yankee dryer is carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products. These blades, together with high-lignin pulps, cooperate to provide unexpected and, indeed, dramatic synergistic effect as discussed in connection with the examples below.

FIGS. 3A through 3D illustrate a portion of a preferred undulatory creping blade 70 useable in the practice of the present invention in which a relief surface 72 extends indefinitely in length, typically exceeding 100 inches in length and often reaching over 26 feet in length to correspond to the width of the Yankee dryer on the larger modern paper machines. Flexible blades of the patented undulatory blade having indefinite length can suitably be placed on a spool and used on machines employing a continuous creping system. In such cases the blade length would be several times the width of the Yankee dryer. In contrast, the height of the blade 70 is usually on the order of several inches while the thickness of the body is usually on the order of fractions of an inch.

As illustrated in FIGS. 3A through 3D, an undulatory cutting edge 73 of the patented undulatory blade is defined by serrulations 76 disposed along, and formed in, one edge of the surface 72 so as to define an undulatory engagement surface. Cutting edge 73 is preferably configured and dimensioned so as to be in continuous undulatory engagement with Yankee 26 when positioned as shown in FIG. 2, that is, the blade continuously contacts the Yankee cylinder in a sinuous line generally parallel to the axis of the Yankee cylinder. In particularly preferred embodiments, there is a continuous undulatory engagement surface 80 having a plurality of substantially collinear rectilinear elongate regions 82 adjacent a plurality of crescent shaped regions 84 about a foot 86 located at the upper portion of the side 88 of the blade which is disposed adjacent the Yankee. Undulatory surface 80 is thus configured to be in continuous surface-to-surface contact over the width of a Yankee cylinder when in use as shown in FIGS. 1 and 2 in an undulatory or sinuous wave-like pattern.

The number of teeth per inch may be taken as the number of elongate regions 82 per inch and the tooth depth is taken as the height, H, of the groove indicated at 81 adjacent surface 88.

Several angles are used in order to describe the geometry of the cutting edge of the undulatory blade of the patented undulatory blade. To that end, the following terms are used:

Creping angle "$\alpha$"—the angle between a rake surface 78 of the blade 70 and the plane tangent to the Yankee at the point of intersection between the undulatory cutting edge 73 and the Yankee;

Axial rake angle "$\beta$"—the angle between the axis of the Yankee and the undulatory cutting edge 73 which is the curve defined by the intersection of the surface of the Yankee with indented rake surface of the blade 70;

Relief angle "$\gamma$"—the angle between the relief surface 72 of the blade 70 and the plane tangent to the Yankee at the intersection between the Yankee and the undulatory cutting edge 73, the relief angle measured along the flat portions of the present blade is equal to what is commonly called "blade angle" or holder angle", that is "$\gamma$" in FIG. 2.

Quite obviously, the value of each of these angles will vary depending upon the precise location along the cutting edge at which it is to be determined. The remarkable results achieved with the undulatory blades of the patented undulatory blade in the manufacture of the absorbent paper products are due to those variations in these angles along the cutting edge. Accordingly, in many cases it will be convenient to denote the location at which each of these angles is determined by a subscript attached to the basic symbol for that angle. As noted in the '788 patent, the subscripts "f", "c" and "m" refer to angles measured at the rectilinear elongate regions, at the crescent shaped regions, and the minima of the cutting edge, respectively. Accordingly, "$\gamma_f$", the relief angle measured along the flat portions of the present blade, is equal to what is commonly called "blade angle" or "holder angle". In general, it will be appreciated that the pocket angle $\alpha_f$ at the rectilinear elongate regions is typically higher than the pocket angle $\alpha_c$ at the crescent shaped regions.

While the products of the invention may be made by way of a dry-crepe process, a wet crepe process is preferred in some embodiments, particularly with respect to single-ply towel in some cases. When a wet-crepe process is employed, after-drying section 30 may include an impingement air dryer, a through-air dryer, a Yankee dryer or a plurality of can dryers. Impingement air dryers are disclosed in the following patents and applications, the disclosure of which is incorporated herein by reference:

- U.S. Pat. No. 5,865,955 of Ilvespaaet et al.
- U.S. Pat. No. 5,968,590 of Ahonen et al.
- U.S. Pat. No. 6,001,421 of Ahonen et al.
- U.S. Pat. No. 6,119,362 of Sundqvist et al.
- U.S. patent application Ser. No. 09/733,172, entitled Wet Crepe, Impingement-Air Dry Process for Making Absorbent Sheet, now U.S. Pat. No. 6,432,267; (FJ-99-33).

Figure 4:
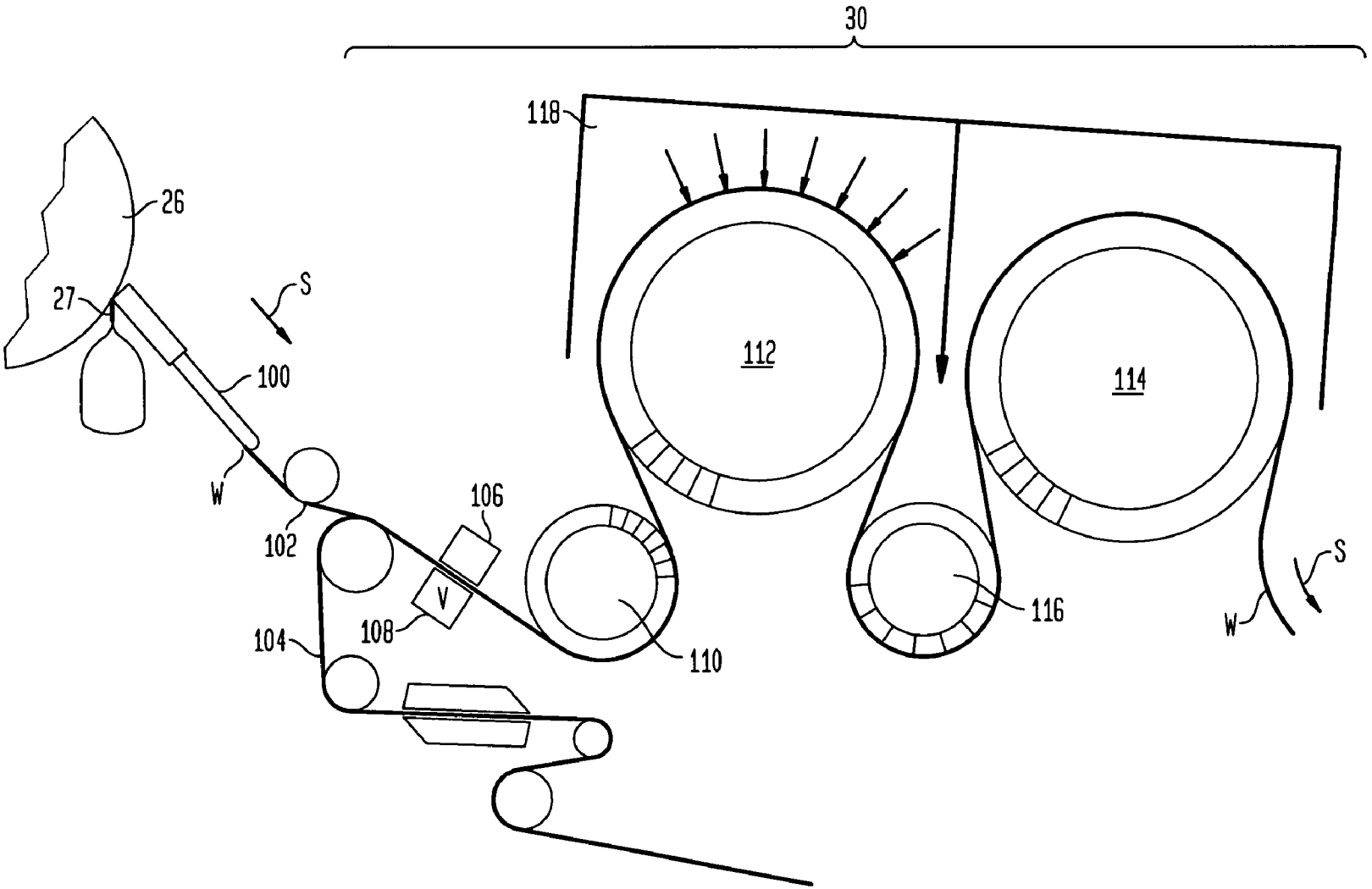
FIG. 4 is a schematic diagram of an impingement air drying section of a paper machine used to dry a wet-creped web.

When an impingement-air after dryer is used, after drying section 30 of FIG. 1 may have the configuration shown in FIG. 4.

There is shown in FIG. 4 an impingement air dry apparatus 30 useful in connection with the present invention. The web is creped off of a Yankee dryer, such as Yankee dryer 26 of FIG. 1 utilizing a creping blade 27. The web W is aerodynamically stabilized over an open draw utilizing an air foil 100 as generally described in U.S. Pat. No. 5,891,309 to Page et al., the disclosure of which is incorporated herein by reference. Following a transfer roll 102, web W is disposed on a transfer fabric 104 and subjected to wet shaping by way of an optional blow box 106 and vacuum shoe 108. The particular conditions and impression fabric selected depend on the product desired and may include conditions and fabrics described above or those described or shown in one or more of: U.S. Pat. No. 5,510,002 to Hermans et al.; U.S. Pat. No. 4,529,480 of Trokhan; U.S. Pat. No. 4,102,737 of Morton and U.S. Pat. No. 3,994,771 to Morgan, Jr. et al., the disclosures of which are hereby incorporated by reference into this section.

After wet shaping, web W is transferred over vacuum roll 110 impingement air-dry system as shown. The apparatus of FIG. 4 generally includes a pair of drilled hollow cylinders 112, 114, a vacuum roll 116 there between as well as a hood 118 equipped with nozzles and air returns. In connection with FIG. 4, it should be noted that transfer of a web W over an open draw needs to be stabilized at high speeds. Rather than use an impingement-air dryer, after-dryer section 30 of FIG. 4 may include instead of cylinders 112,114 a throughdrying unit as is well known in the art and described in U.S. Pat. No. 3,432,936 to Cole et al., the disclosure of which is incorporated herein by reference.

Yet another after-drying section is disclosed in U.S. Pat. No. 5,851,353 which may likewise be employed in a wet-creped process using the apparatus of FIG. 1.

Figure 5:
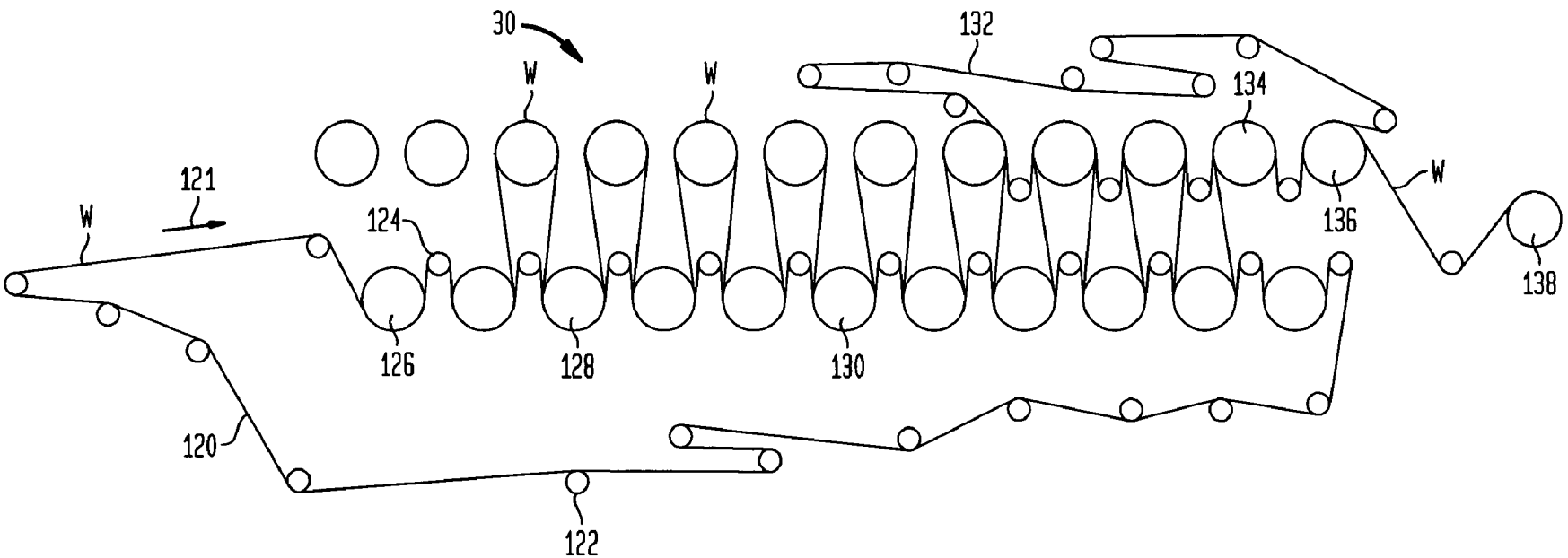
FIG. 5 is a schematic diagram of a can drying section of a paper machine used to dry a wet-creped web.

Still yet another after-drying section 30 is illustrated schematically in FIG. 5. After creping from the Yankee cylinder the web W is deposited on an after-dryer felt 120 which travels in direction 121 and forms an endless lop about a plurality of after-dryer felt rolls such as rolls 122, 124 and a plurality of after-dryer drums such as drums (sometimes referred to as cans) 126, 128 and 130.

A second felt 132 likewise forms an endless loop about a plurality of after-dryer drums and rollers as shown. The various drums are arranged in two rows and the web is dried as it travels over the drums of both rows and between rows as shown in the diagram. Felt 132 carries web W from drum 134 to drum 136, from which web W may be further processed or wound up on a take-up reel 138.

Figure 6:
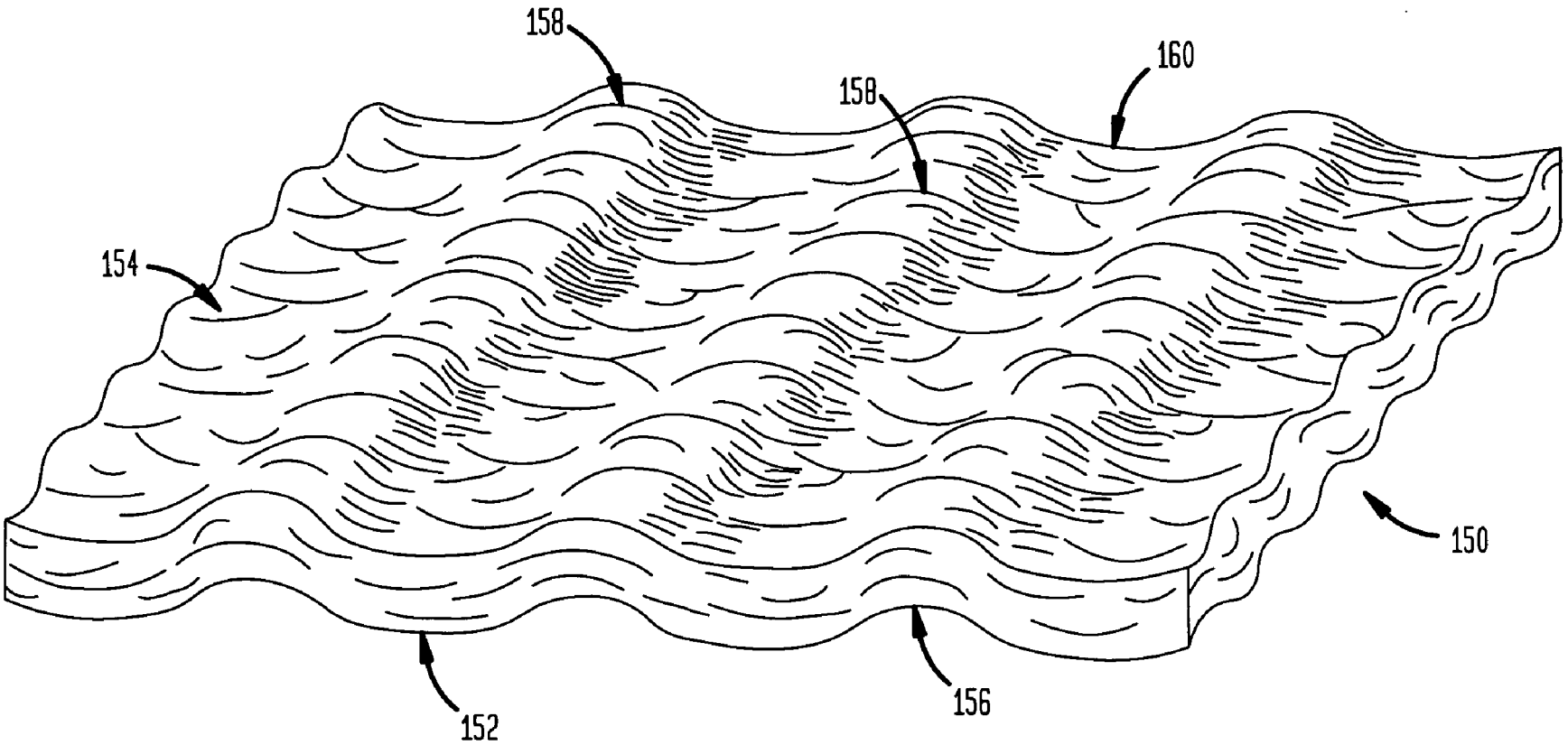
FIG. 6 is a schematic view of a biaxially undulatory product prepared in accordance with the present invention.

The present invention particularly relates to a creped or recreped web as shown in FIG. 6 comprising a biaxially undulatory cellulosic fibrous web 150 creped from a Yankee dryer 26 shown in FIGS. 1 and 2, characterized by a reticulum of intersecting crepe bars 154, and undulations defining ridges 152 on the air side thereof, said crepe bars 154 extending transversely in the cross machine direction, said ridges 152 extending longitudinally in the machine direction, said web 150 having furrows 156 between ridges 152 on the air side as well as crests 158 disposed on the Yankee side of the web opposite furrows 156 and sulcations 160 interspersed between crests 158 and opposite to ridges 152, wherein the spatial frequency of said transversely extending crepe bars 154 is from about 10 to about 150 crepe bars per inch, and the spatial frequency of said longitudinally extending ridges 152 is from about 4 to about 50 ridges per inch. It should be understood that strong calendering of the sheet made with this invention can significantly reduce the height of ridges 152, making them difficult to perceive by the eye, without loss of the beneficial effects of this invention.

The crepe frequency count for a creped base sheet or product may be measured with the aid of a microscope. The Leica Stereozoom RTM 4 microscope has been found to be particularly suitable for this procedure. The sheet sample is placed on the microscope stage with its Yankee side up and the cross direction of the sheet vertical in the field of view. Placing the sample over a black background improves the crepe definition. During the procurement and mounting of the sample, care should be taken that the sample is not stretched. Using a total magnification of 18-20, the microscope is then focused on the sheet. An illumination source is placed on either the right or left side of the microscope stage, with the position of the source being adjusted so that the light from it strikes the sample at an angle of approximately 45 degrees. It has been found that Leica or Nicholas Illuminators are suitable light sources. After the sample has been mounted and illuminated, the crepe bars are counted by placing a scale horizontally in the field of view and counting the crepe bars that touch the scale over a one-half centimeter distance. This procedure is repeated at least two times using different areas of the sample. The values obtained in the counts are then averaged and multiplied by the appropriate conversion factor to obtain the crepe frequency in the desired unit length.

It should be noted that the thickness of the portion of web 150 between longitudinally extending crests 158 and furrows 156 will on the average typically be about 5% greater than the thickness of portions of web 150 between ridges 152 and sulcations 160. Suitably, the portions of web 150 adjacent longitudinally extending ridges 152 (on the air side) are about from about 1% to about 7% thinner than the thickness of the portion of web 150 adjacent to furrows 156 as defined on the air side of web 150.

The height of ridges 152 correlates with the tooth depth H formed in undulatory creping blade 70. At a tooth depth of about 0.010 inches, the ridge height is usually from about 0.0007 to about 0.003 inches for sheets having a basis weight of 14-19 pounds per ream. At double the depth, the ridge height increases to 0.005 to 0.008 inches. At tooth depths of about 0.030 inches, the ridge height is about 0.010 to 0.013 inches. At higher undulatory depth, the height of ridges 152 may not increase and could in fact decrease. The height of ridges 152 also depends on the basis weight of the sheet and strength of the sheet.

Advantageously, the average thickness of the portion of web 150 adjoining crests 158 is significantly greater than the thickness of the portions of web 150 adjoining sulcations 160; thus, the density of the portion of web 150 adjacent crests 158 can be less than the density of the portion of web 150 adjacent sulcations 160. The process of the present invention produces a web having a specific caliper of from about 2 to about 8 mils per 8 sheets per pound of basis weight. The usual basis weight of web 150 is from about 7 to about 35 lbs/3000 sq. ft. ream.

Suitably, when web 150 is calendered, the specific caliper of web 150 is from about 2.0 to about 6.0 mils per 8 sheets per pound of basis weight and the basis weight of said web is from about 7 to about 35 lbs/3000 sq. ft. ream.

In some embodiments according to the present invention, the webs are processed with embossing rolls having substantially identical embossing element patterns, with at least a portion of the embossing elements configured such that they are capable of producing perforating nips which are capable of perforating the web. As the web is passed through the nip, an embossing pattern is thus imparted on the web by the embossing rolls. It is preferred that the embossing rolls be either steel or hard rubber, or other suitable polymer. The direction of the web as it passes through the nip is referred to as the machine direction. The transverse direction of the web that spans the emboss roll is referred to as the cross-machine direction. It is further preferred that a predominant number, i.e., at least 50% or more, of the perforations are configured to be oriented such that the major axis of the perforation is substantially oriented in the cross-machine direction. An embossing element is substantially oriented in the cross-machine direction when the long axis of the perforation nip formed by the embossing element is at an angle of from a bout 60° to 120° from the machine direction of the web. As noted above, perforate embossing may or may not produce macro-apertures through the sheet, but may instead selectively increase light transmittance through the sheet in some areas.

Figure 7:
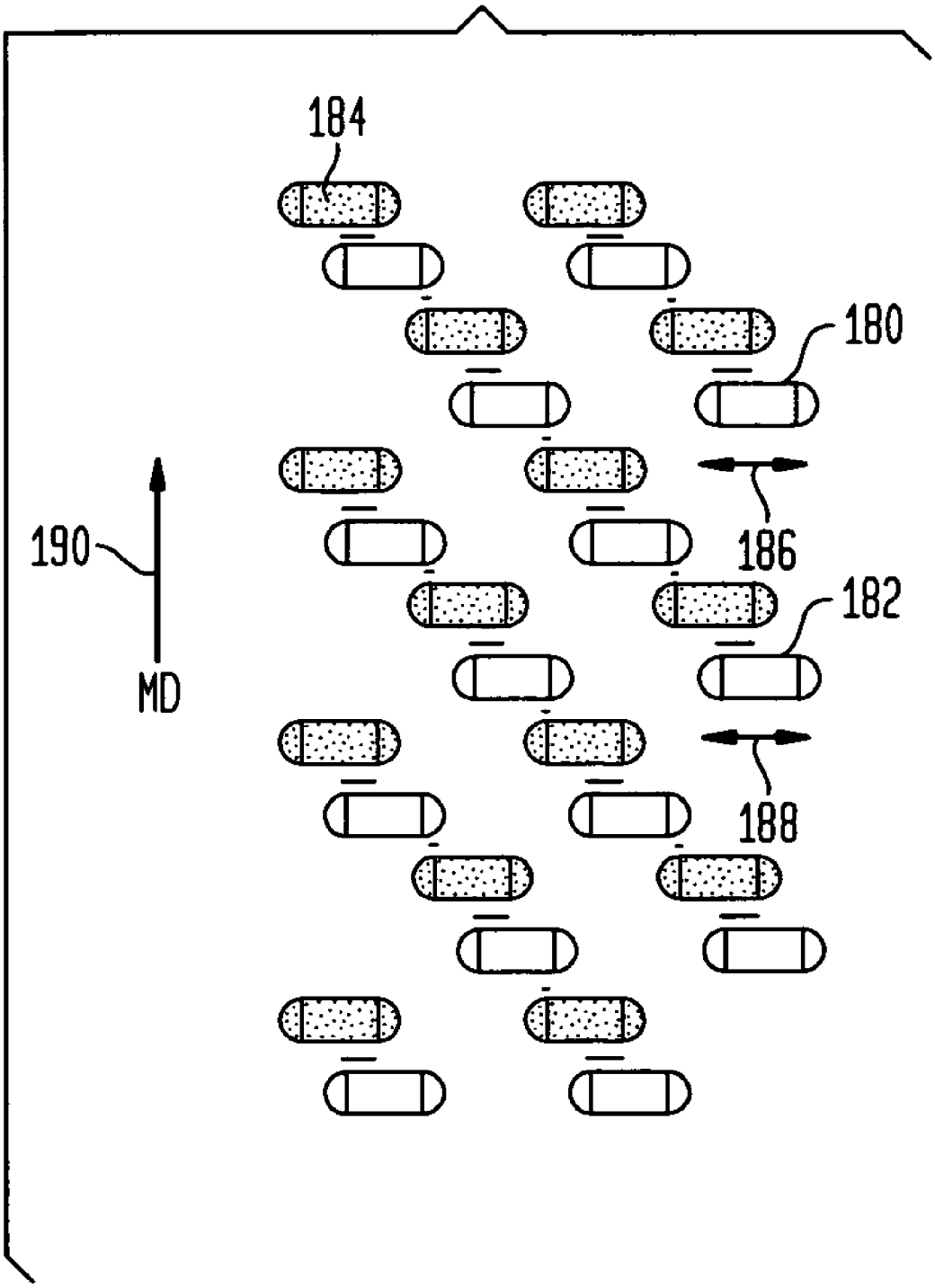
FIG. 7 is a schematic diagram illustrating an emboss pattern which may be utilized in connection with products of the invention.

A variety of element shapes can be successfully used in the present invention. The element shape is the "footprint" of the top surface of the element, as well as the side profile of the element. It is preferred that the elements have a length (in the cross-machine direction)/width (in the machine direction) (L/W) aspect ratio of at least greater than 1.0; however, while noted above as sub-optimal, the elements can have an aspect ratio of less than 1.0. It is further preferred that the aspect ratio be about 2.0. One element shape that can be used in this invention is a hexagonal element. Another element shape, termed a CD oval, is depicted in FIG. 7. It will be appreciated from FIG. 7 that the emboss design includes a plurality of oval-shaped elements 180, 182, 184 and so forth on opposed embossing rolls which pattern is transferred to the web. The various elements have the major axes 186, 188 and so forth generally perpendicular to machine direction 190, which is the direction of manufacture of the web indicated by arrow S on FIGS. 1 and 4, for example. For oval elements, it is preferred that the ends have radii of at least about 0.003" and less than about 0.030" for at least the side of the element forming a perforate nip. In one embodiment, the end radii are about 0.135". Those of ordinary skill in the art will understand that a variety of different embossing element shapes, such as rectangular, can be employed to vary the embossing pattern. Embossing techniques and geometries are further described in U.S. Pat. No. 6,733,626 issued May 11, 2004, entitled "An Apparatus and Method for Degrading a Web in the Machine Direction While Preserving Cross-Machine Direction Strength", the disclosure of which is incorporated by reference.

EXAMPLES 1-2 AND COMPARATIVE EXAMPLES A THROUGH E

A series of one-ply wet-creped towels were prepared as indicated in Table 2 below. The towels consisted essentially of recycled fiber provided with the amount of BCTMP shown in Table 2 below.

Figure 8:
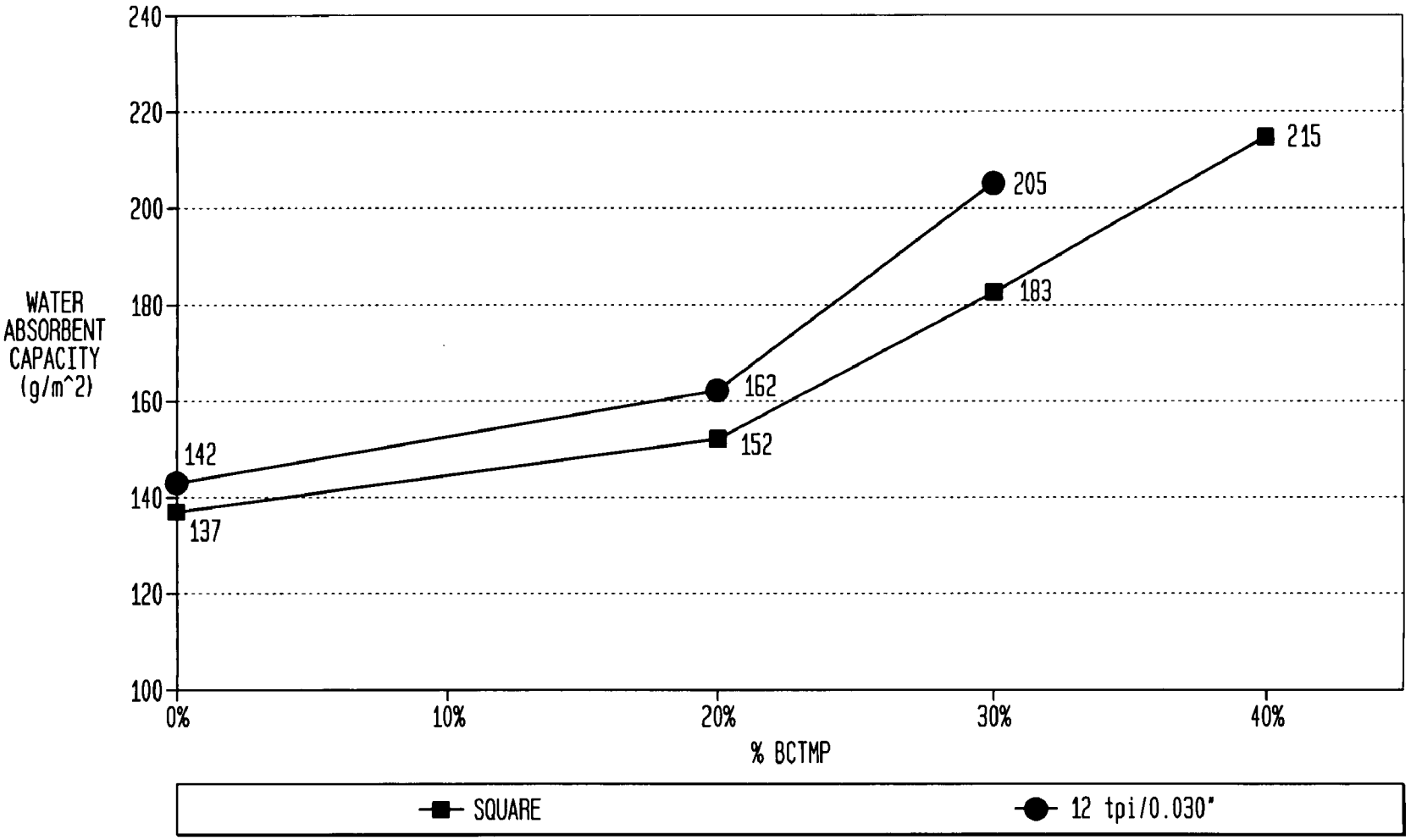
FIG. 8 is a plot of water absorbent capacity versus BCTMP content for various products made using a wet-crepe process.
Figure 9:
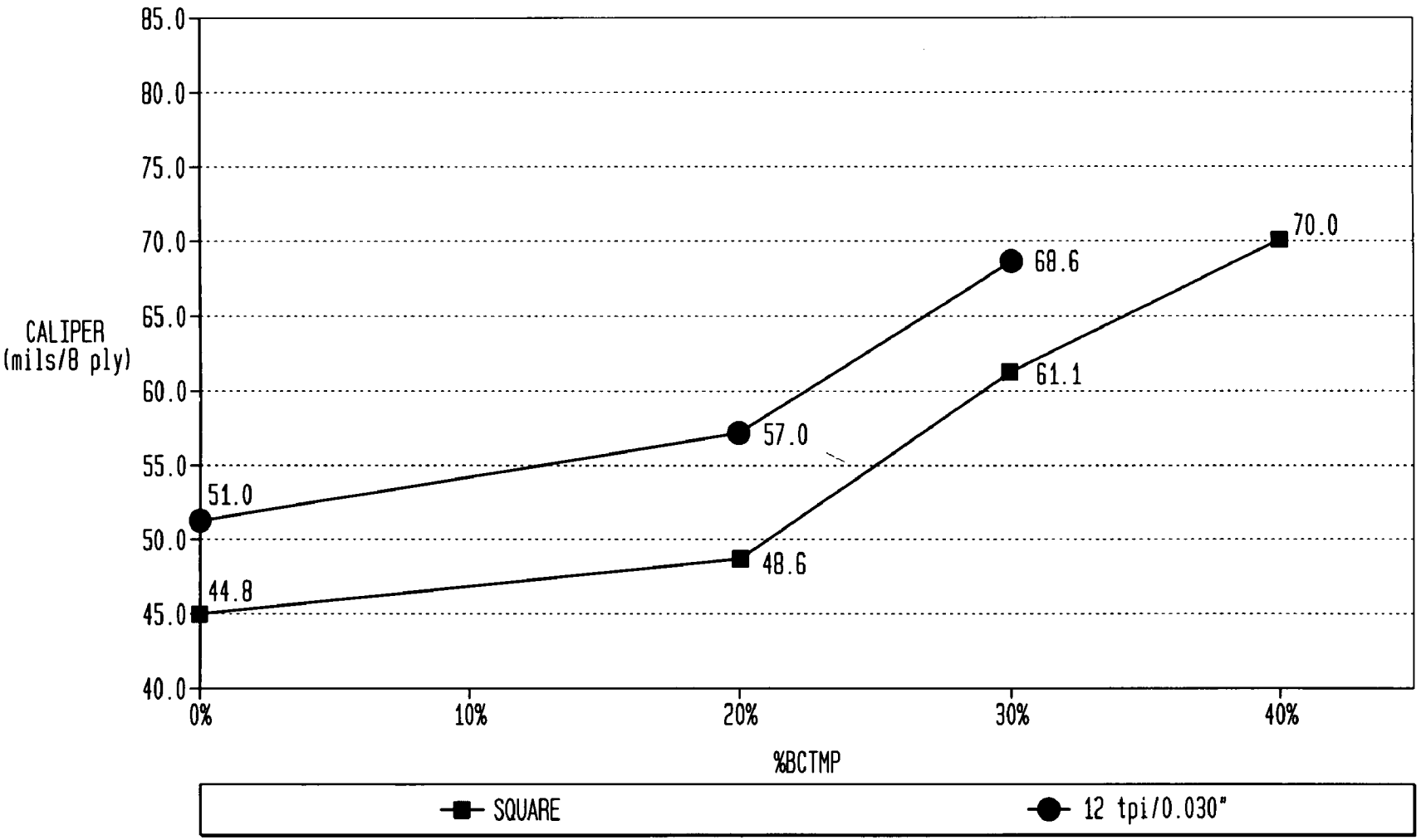
FIG. 9 is a plot of caliper versus BCTMP content for various wet-creped products.
Figure 10:
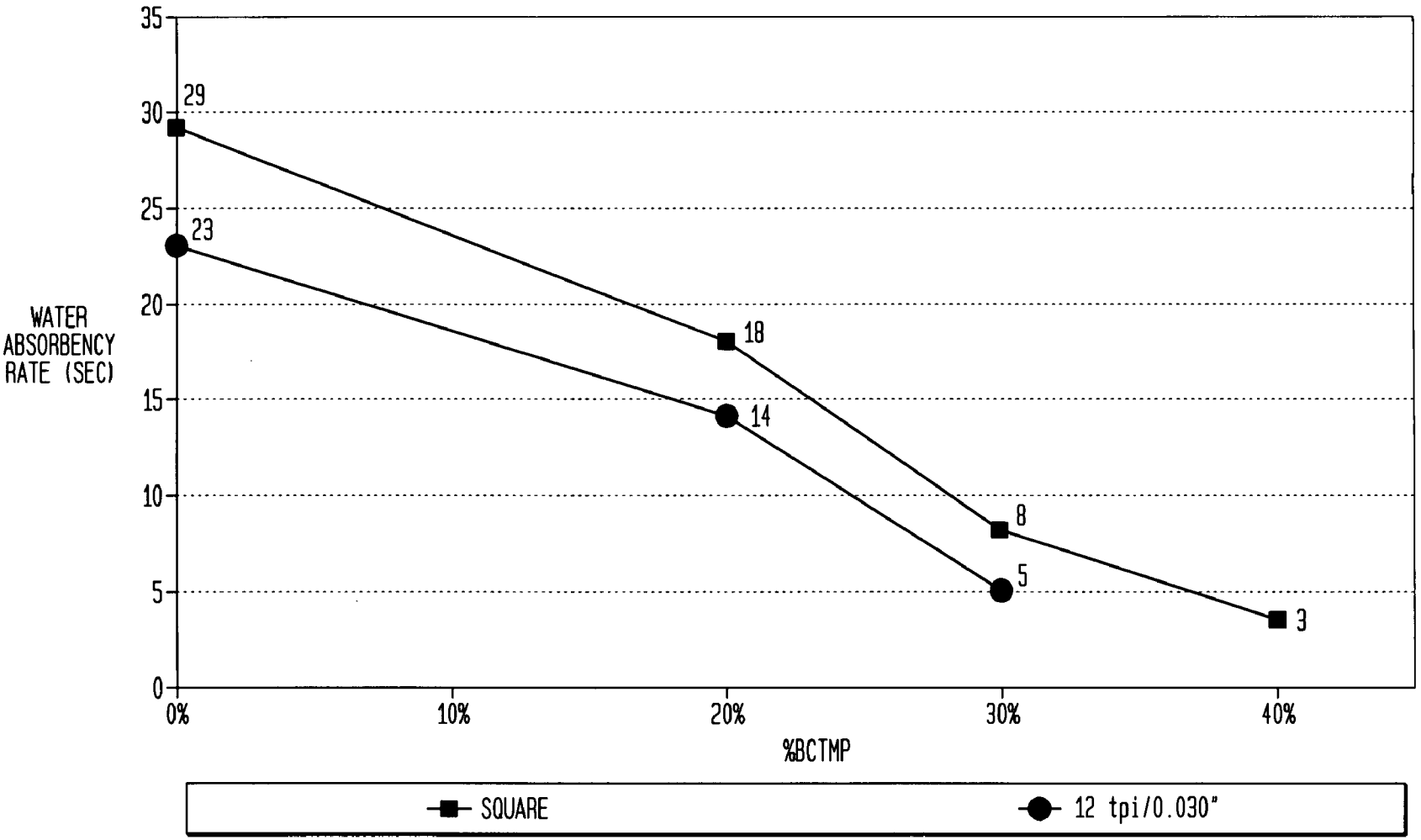
FIG. 10 is a plot of Water Absorbency Rate versus BCTMP content for various wet-creped products.

The synergies are calculated based on Examples A and B as well as measurements based on a sheet made from the same composition in terms of fiber and the same approximate basis weight. In the first step in calculating the percent synergy, the expected creping blade delta is calculated as the difference between examples A and B. For example, one expects a 142-137 or 5 g/m$^2$ increase in WAC in absorbent capacity (WAC) based on the use of an undulatory blade. Next, one calculates the synergy as the difference between the observed value and the expected value divided by the expected delta× 100%. For WAC in Example 1, this calculates as: (162−(152+5))/5×100% or 100% greater than the expected increase based on additive effects. As can be seen from Table 2, large absorbency synergies as well as significant caliper increases may be achieved in accordance with the invention. Likewise, products made with BCTMP and an undulatory creping blade exhibit remarkable increases in water absorbency rates (WAR). The differences seen in Table 2 and FIGS. 8 through 10 are consistent with the observed increase in void volume or increase in bulk as can be seen in FIGS. 11A and 11B. FIG. 11A is a photomicrograph of a creped towel including only conventional fiber along the cross-machine direction, whereas FIG. 11B is a photomicrograph of a creped towel along the cross-machine direction prepared in accordance with the invention including 40% BCTMP. As will be appreciated from these Figures, the BCTMP containing towel exhibits much more delamination than the towel prepared with only conventional fiber.

COMPARATIVE EXAMPLES F-I AND EXAMPLES 3, 4

Following generally the procedure described above, a series of one-ply wet-creped towel was prepared using different creping blades and furnish compositions. The furnish composition was predominantly recycled fiber supplemented by various amounts of BCTMP as shown in Table 3. After the towel was manufactured, it was embossed with a CD oval design as described in co-pending patent application Ser. No. 10/036,770 as indicated on FIGS. 12 and 13 and described above.

TABLE 2

| | Absorbency/Caliper Synergy | | | | | | |
|---|---|---|---|---|---|---|---|
| | Example A | Example B | Example C | Example 1 | Example D | Example 2 | Example E |
| Creping Blade | Square | 12 tpi/0.030" | Square | 12 tpi/0.030" | Square | 12 tpi/0.030" | Square |
| % BCTMP | 0% | 0% | 20% | 20% | 30% | 30% | 40% |
| % Recycled Fiber | 100% | 100% | 80% | 80% | 70% | 70% | 60% |
| Wet Strength Resin (#/T) | Optimized | Optimized | Optimized | Optimized | Optimized | Optimized | Optimized |
| CMC* | None | None | None | None | None | Yes | Yes |
| BW (lbs./ream) | 28.0 | 28.0 | 28.0 | 28.0 | 28.0 | 28.0 | 28.0 |
| | The web consistency at the blade is between 60% to 85% | | | | | | |
| WAC | 137 | 142 | 152 | 162 | 183 | 205 | 215 |
| WAC Synergy | — | — | — | 100% | — | 340% | — |
| Caliper | 44.8 | 51 | 48.6 | 57 | 61.1 | 68.6 | 70 |
| Caliper Synergy % | — | — | — | 35% | — | 21% | — |

*Carboxy Methyl Cellulose

As will be appreciated from Table 2, the use of BCTMP together with an undulatory creping blade of 12 tpi/30 mil tooth depth exhibited remarkable synergy. Data for the towels also appears plotted on FIGS. 8 through 10.

Figure 12:
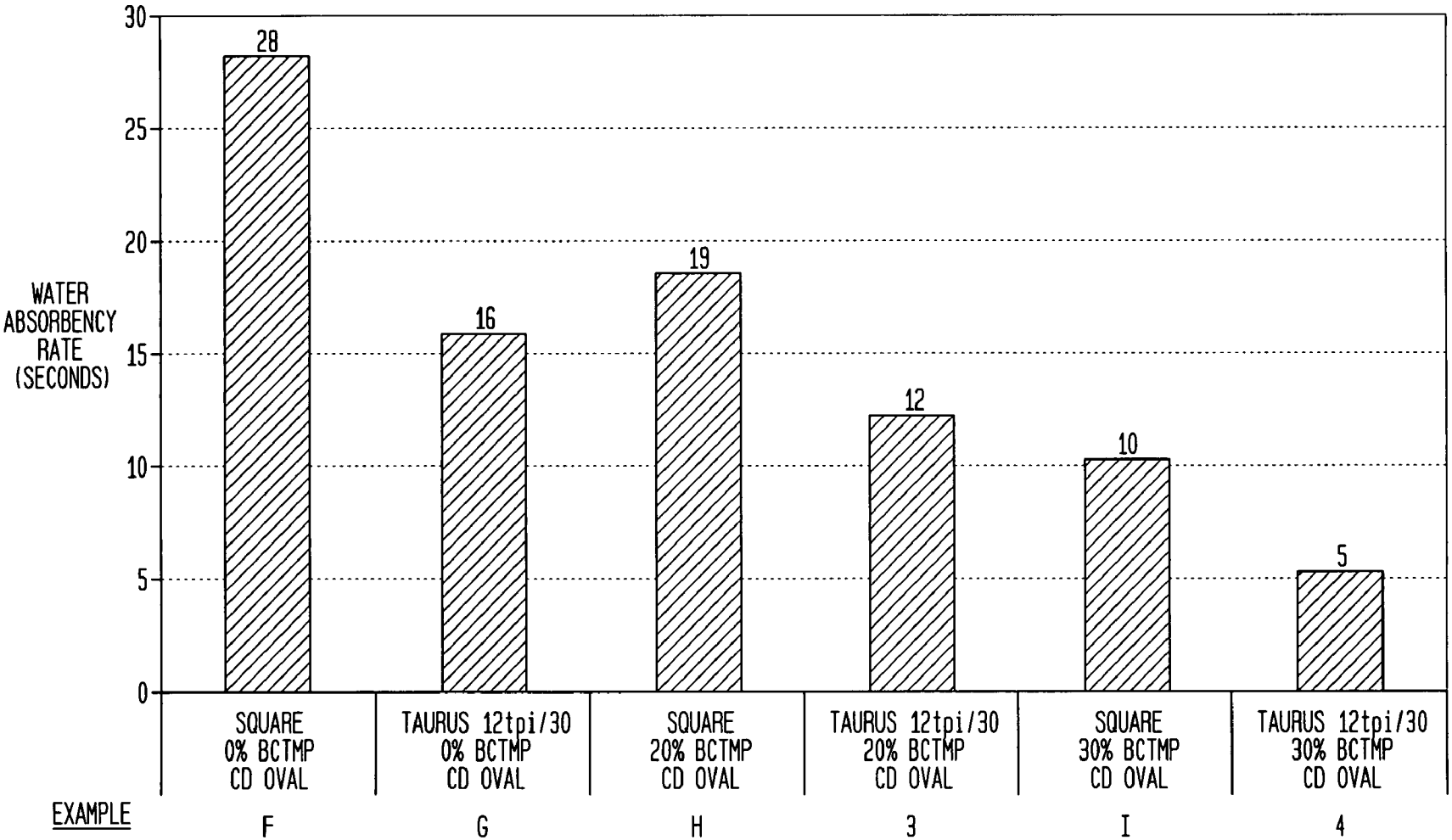
FIG. 12 is a bar graph illustrating water absorbency rate for various wet-creped products.

FIG. 12 is a bar graph illustrating water absorbency rate (WAR) for various compositions and methods of preparation. Likewise, FIG. 13 is a bar graph showing void volume ratio of the various products.

TABLE 3

| | Examples F-I and 3, 4 | | | | | |
|---|---|---|---|---|---|---|
| | Example F | Example G | Example H | Example 3 | Example I | Example 4 |
| Creping Blade | Square | 12 tpi/0.030" | Square | 12 tpi/0.030" | Square | 12 tpi/0.030" |
| % BCTMP | 0% | 0% | 20% | 20% | 30% | 30% |
| % Recycled Fiber | 100% | 100% | 80% | 80% | 70% | 70% |
| Wet Strength Resin (#/T) | Optimized | Optimized | Optimized | Optimized | Optimized | Optimized |
| CMC* | None | None | None | None | None | Yes |
| BW (lbs./ream) | 28.0 | 28.0 | 28.0 | 28.0 | 28.0 | 28.0 |

Figure 13:
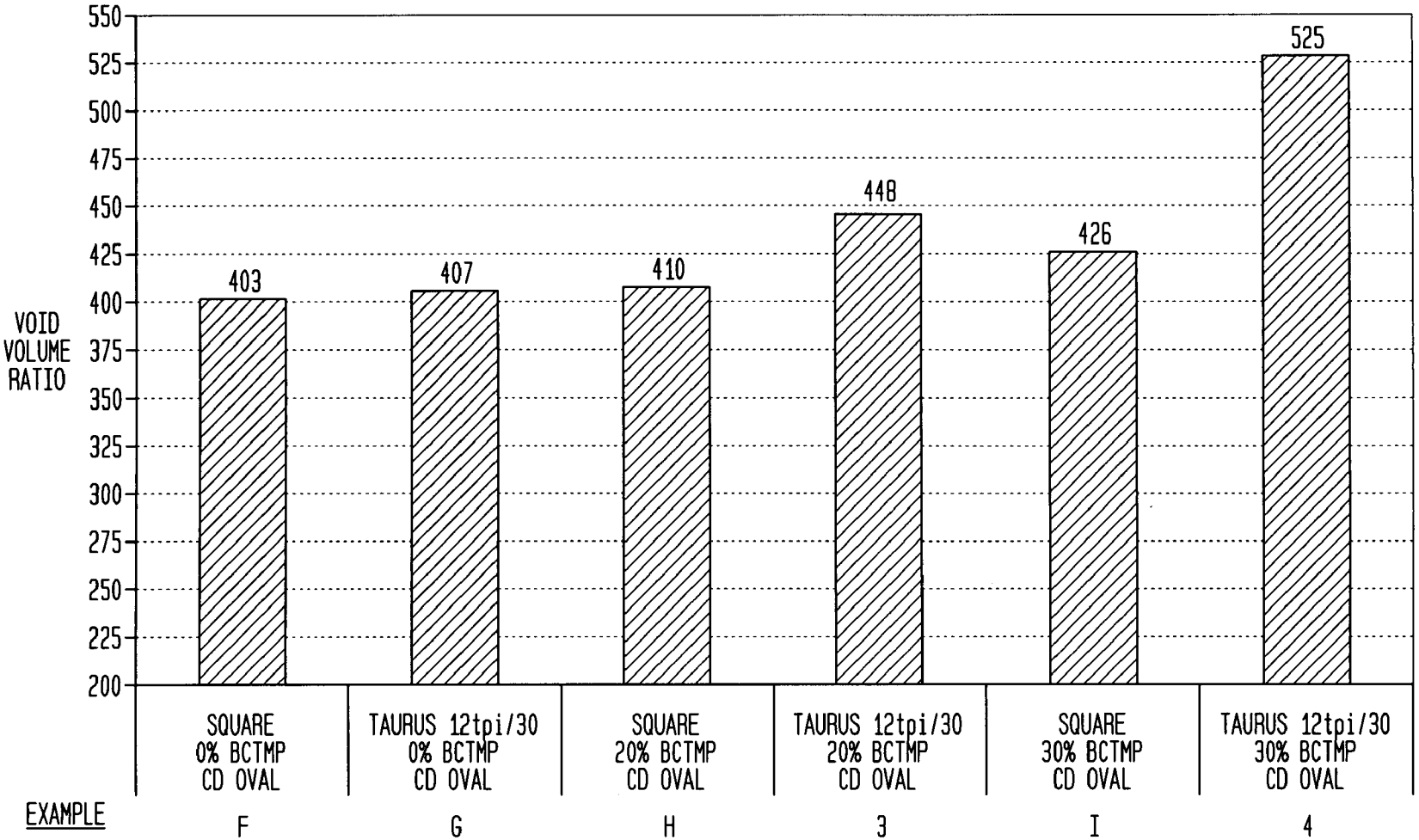
FIG. 13 is a bar graph illustrating bulk density for various wet-creped products.

The web consistency at the creping blade is between 60% to 85%.
*Carboxy Methyl Cellulose It can be seen from FIGS. 12 and 13 that the towels of the invention exhibit a higher initial absorbency (lower WAR values in seconds) and higher bulk. Indeed, at a 30% BCTMP level, a product prepared with an undulating blade, 12 tpi, 30 mil tooth depth (Example 4) exhibited a water absorbency rate of twice that of a corresponding product prepared with a square blade (Example I).

ADDITIONAL EXAMPLES

Following generally the procedures noted above, a series of one-ply wet-creped towels were prepared and embossed as indicated in Table 4. The various properties of the towels were then measured.

TABLE 4

| Embossed Towel Properties | | | | | |
|---|---|---|---|---|---|
| | Example 5 | | | | |
| Blade | STD Blade | 12tpi-0.030" | 12tpi-0.030" | 12tpi-0.030" | |
| Furnish | 67% SWD + 33% HWD | 80% SWD + 15% HWD | 70% Recycle | 67% SWD + 33% HWD | Commercially available Uncreped TAD Towel |
| % BCTMP | 0% BCTMP | 5% BCTMP | 30% BCTMP | 0% BCTMP | |
| Emboss Design | Diamond Rain Drop | Diamond Rain Drop | CD Oval | Diamond Rain Drop | No Emboss |
| Basis Weight (lbs/rm) | 27.7 | 27.1 | 28.0 | 27.3 | 22.8 |
| Caliper (mils/8 sheets) | 84.5 | 92.7 | 82.7 | 97.4 | 80.0 |
| Dry MD Tensile (g/3") | 5676 | 4776 | 4449 | 4878 | 3731 |
| Dry CD Tensile (g/3") | 2546 | 2689 | 3404 | 2827 | 3000 |
| GMT | 3802 | 3584 | 3892 | 3713 | 3346 |
| MD Stretch (%) | 8.3 | 8.9 | 10.7 | 9.0 | 12.3 |
| CD Stretch (%) | 5.2 | 6.3 | 5.4 | 6.2 | 6.0 |
| Wet MD Cured Tensile (g/3") | 1584 | 1366 | 1539 | 1439 | 1100 |
| Wet CD Cured Tensile (g/3") | 635 | 716 | 1048 | 775 | 799 |
| CD Wet/Dry Ratio (%) | 24.9% | 26.6% | 30.8% | 27.4% | 26.6% |
| WAR (seconds) (TAPPI) | 17 | 10 | 5 | 13 | 4 |
| MacBeth 3100 Brightness (%) UV Excluded | 78.8 | 80.0 | 77.4 | 81.3 | 79.2 |
| SAT Capacity ($g/m^2$) | 151.2 | 173.0 | 210.8 | 164.6 | 216.0 |
| Sintech Modulus | 152.6 | 117.1 | 146.7 | 109.2 | 149.4 |
| Void Volume Ratio (%) | 363.9 | 394.5 | 490.5 | 376.1 | 558.7 |
| | Example | | | | |
| | 6 | 7 | 8 | | |
| Blade | 12tpi-0.030" | 8tpi-0.035" | 12tpi-0.030" | Square Blade | |
| Furnish | 70% Recycle | 70% Recycle | 70% Recycle | 100% Virgin Fiber | Commercially Available CWP Towel |

TABLE 4-continued

| Embossed Towel Properties | | | | | |
|---|---|---|---|---|---|
| % BCTMP | 30% BCTMP | 30% BCTMP | 30% BCTMP | | |
| Emboss Design | MD Quilt | Hollow Diamond | Hollow Diamond | 10M | MD Quilt |
| Basis Weight (lbs/rm) | 28.5 | 28.2 | 27.9 | 24.6 | 28.3 |
| Caliper (mils/8 sheets) | 79.4 | 78.1 | 76.8 | 58.6 | 69.6 |
| Dry MD Tensile (g/3") | 5016 | 4798 | 4601 | 7019 | 5455 |
| Dry CD Tensile (g/3") | 2852 | 3090 | 3032 | 3063 | 2359 |
| GMT | 3782 | 3851 | 3735 | 4637 | 3587 |
| MD Stretch (%) | 10.9 | 9.9 | 9.2 | 10.1 | 9.4 |
| CD Stretch (%) | 6.6 | 6.0 | 5.5 | 5.8 | 5.2 |
| Wet MD Cured Tensile (g/3") | 1749 | 1547 | 1309 | 1804 | 1780 |
| Wet CD Cured Tensile (g/3") | 921 | 911 | 848 | 679 | 736 |
| CD Wet/Dry Ratio (%) | 32.3% | 29.5% | 28.0% | 22.2% | 31.2% |
| WAR (seconds) (TAPPI) | 6 | 7 | 5 | 14 | 22 |
| MacBeth 3100 Brightness (%) UV Excluded | 77.3 | 77.5 | 77.4 | 85.1 | 79.3 |
| SAT Capacity ($g/m^2$) | 196.0 | 206.8 | 205.5 | 143.7 | 173.9 |
| Sintech Modulus | 119.0 | 158.8 | 165.2 | 189.5 | 229.1 |
| Void Volume Ratio (%) | 482.7 | 482.4 | 486.3 | 428.6 | 449.9 |

| | J | K | | |
|---|---|---|---|---|
| Blade | Square | Square | Square | 15% Bevel |
| Furnish | 100% Recycle | 100% Recycle | 60% Recycle | 67% SWD + 33% HWD |
| % BCTMP | | | 40% BCTMP | |
| Emboss Design | 10M | Hollow Diamond | Hollow Diamond | Diamond Rain Drop |
| Basis Weight (lbs/rm) | 32.1 | 31.2 | 28.5 | 25.0 |
| Caliper (mils/8 sheets) | 60.0 | 77.1 | 76.1 | 77.9 |
| Dry MD Tensile (g/3") | 6320 | 5273 | 4683 | 6594 |
| Dry CD Tensile (g/3") | 3467 | 3237 | 2812 | 3400 |
| GMT | 4681 | 4132 | 3629 | 4735 |
| MD Stretch (%) | 6.0 | 5.4 | 11.1 | 9.8 |
| CD Stretch (%) | 5.2 | 5.3 | 4.9 | 4.6 |
| Wet MD Cured Tensile (g/3") | 1368 | 963 | 1586 | 2222 |
| Wet CD Cured Tensile (g/3") | 692 | 624 | 930 | 940 |
| CD Wet/Dry Ratio (%) | 19.9% | 19.3% | 33.1% | 27.6% |
| WAR (seconds) (TAPPI) | 29 | 18 | 3 | 35 |
| MacBeth 3100 Brightness (%) UV Excluded | 76.3 | 76.1 | 76.1 | 83.1 |
| SAT Capacity ($g/m^2$) | 130.8 | 163.3 | 214.7 | 127.6 |
| Sintech Modulus | 221.8 | 239.6 | 131.2 | 191.3 |
| Void Volume Ratio (%) | 315.3 | 369.8 | 528.0 | 337.3 |

The towels described above and in Table 4 were submitted for consumer testing and given an overall rating. Testing was conducted by consumers who rated the products for drying hands, feel, overall appearance, thickness, strength when wet, absorbency, speed of absorbency, texture, ease of dispensing, being clothlike, softness, durability and so forth. An overall rating was also assigned.

Figure 14:
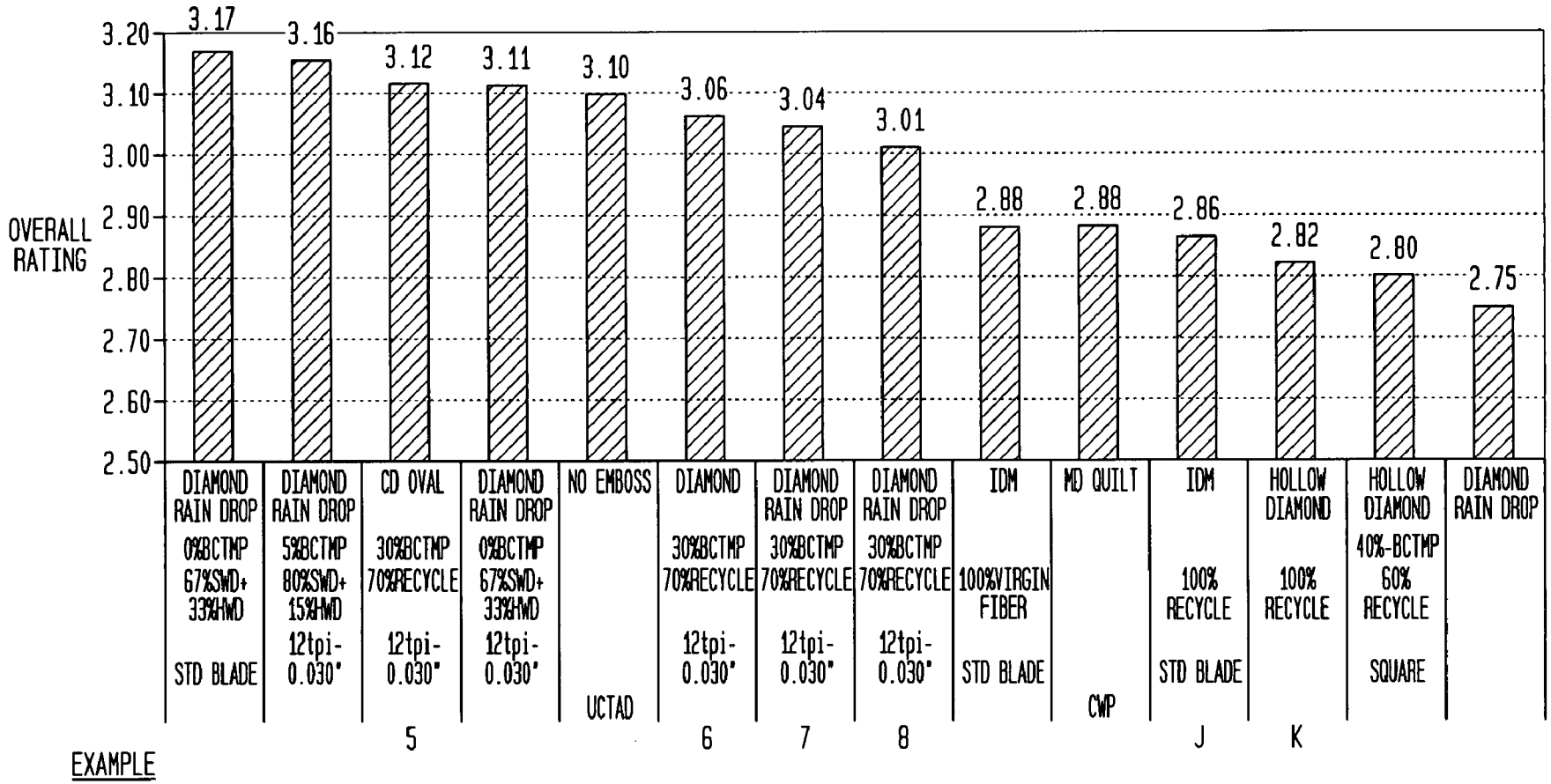
FIG. 14 is a bar graph illustrating overall consumer ratings for various products.

Results appear in FIG. 14.

Figure 15:
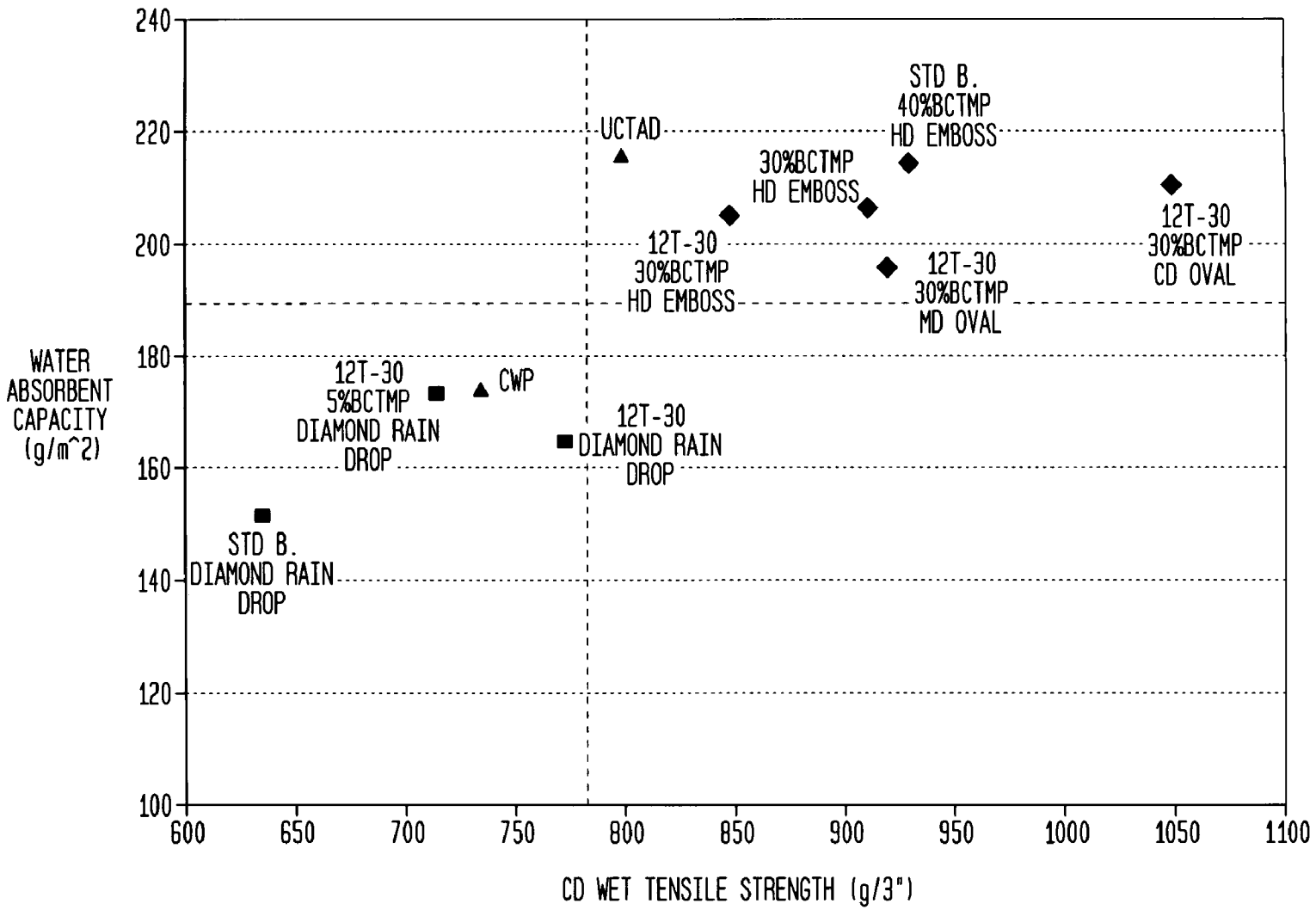
FIG. 15 is a plot of water absorbent capacity versus CD wet tensile for products of the invention and various existing products.

In FIG. 15, there is shown WAC values and CD wet tensile values of products of the invention as well as other products.

While the invention has been described in connection with numerous examples, modifications thereto within the spirit and scope of the present invention will be readily apparent to those of skill in the art.

What is claimed is:

1. A wet-crepe process for making absorbent sheet comprising the steps of:

(a) preparing an aqueous cellulosic fibrous furnish, wherein at least about 15% by weight of the fiber based on the weight of cellulosic fiber in the furnish is lignin-rich, high coarseness, high yield, virgin fiber having an average fiber length of at least about 2 mm and a coarseness of at least about 20 mg/100 m;

(b) depositing said aqueous fibrous furnish on a foraminous support;

(c) dewatering said furnish to form a web;

(d) applying said dewatered web to a heated rotating cylinder and drying said web to a consistency of greater than about 30% and less than about 90%;

(e) creping said web from said heated cylinder at said consistency of greater than about 30% and less than about 90% with a creping blade provided with an undulatory creping surface adapted to contact said cylinder; and (f) drying said web subsequent to creping said web from said heated cylinder to form said absorbent sheet.

2. The wet-crepe process according to claim 1, wherein said web is dried to a consistency of from about 40 to about 80% prior to creping said web from said heated rotating cylinder.

3. The wet-crepe process according to claim 1, wherein said undulatory creping blade is provided with from about 4 to about 50 teeth per inch.

4. The wet-crepe process according to claim 1, wherein said undulatory creping blade has a tooth depth of from about 5 to about 50 mils.

5. The wet-crepe process according to claim 4, wherein said undulatory creping blade has a tooth depth of from about 15 to about 40 mils.

6. The wet-crepe process according to claim 4, wherein said aqueous cellulosic furnish is predominantly recycle fiber.

7. The wet-crepe process according to claim 6, containing at least 15% by weight lignin-rich, high coarseness, high yield, virgin fiber, wherein said lignin-rich, high coarseness, high yield, virgin fiber has an average fiber length of at least about 2.25 mm.

8. The wet-crepe process according to claim 6, containing at least 15% by weight lignin-rich, high coarseness, high yield, virgin fiber, wherein said lignin-rich, high coarseness, high yield, virgin fiber has an average fiber length of from about 2.25 mm to about 2.75 mm.

9. The wet-crepe process according to claim 6, containing at least 15% by weight lignin-rich, high coarseness, high yield, virgin fiber, wherein said lignin-rich, high coarseness, generally tubular fiber has a coarseness of from about 20 mg/100 m to about 30 mg/100 m.

10. The wet-crepe process according to claim 6, containing at least 15% by weight lignin-rich, high coarseness, high yield, virgin fiber, wherein said lignin-rich, high coarseness, generally tubular fiber is a fiber selected from the group consisting of: APMP, TMP, CTMP, BCTMP, and mixtures thereof.

11. A dry-crepe process for making absorbent sheet comprising:

(a) preparing an aqueous cellulosic fibrous furnish, wherein at least about 15% by weight 'of the fiber based on the weight of cellulosic fiber in the furnish is lignin-rich, high coarseness high yield, virgin fiber having an average fiber length of at least about 2 mm and a coarseness of at least about 20 mg/100 m;

(b) depositing said aqueous fibrous furnish on a foraminous support;

(c) dewatering said furnish to form a web;

(d) applying said dewatered web to a heated rotating cylinder and drying said web to a consistency of greater than about 90%; and (e) creping said web from said heated cylinder at said consistency of greater than about 90% with a creping blade provided with an undulatory creping surface adapted to contact said cylinder.

12. The process according to claim 11, wherein said web is dried to a consistency of greater than about 95% on said heated rotating cylinder prior to creping.

13. The process according to claim 11, wherein said undulatory creping blade is provided with from about 4 to about 50 teeth per inch.

14. The process according to claim 11, wherein said undulatory creping blade has a tooth depth of from about 5 to about 50 mils.

15. The process according to claim 14, wherein said undulatory creping blade has a tooth depth of from about 15 to about 40 mils.

16. The process according to claim 11, wherein said aqueous cellulosic furnish is predominantly recycle fiber.

17. The process according to claim 16, containing at least 15% by weight lignin-rich, high coarseness, high yield, virgin fiber, wherein said lignin-rich, high coarseness, high yield, virgin fiber has an average fiber length of at least about 2.25 mm.

18. The process according to claim 16, containing at least 15% by weight lignin-rich, high coarseness, high yield, virgin fiber, wherein said lignin-rich, high coarseness, high yield, virgin fiber has an average fiber length of from about 2.25 mm to about 2.75 mm.

19. The process according to claim 16, containing at least 15% by weight lignin-rich, high coarseness, high yield, virgin fiber, wherein said lignin-rich, high coarseness, high yield, virgin fiber has a coarseness of from about 20 mg/100 m to about 30 mg/100 m.

20. A wet-crepe process for making absorbent sheet comprising the steps of:

(a) preparing an aqueous cellulosic fibrous furnish, wherein at least about 15% by weight of the fiber based on the weight of cellulosic fiber in the furnish is lignin rich, high coarseness high yield, virgin fiber having an average fiber length of at least about 2 mm and a coarseness of at least about 20 mg/100 m;

(b) depositing said aqueous fibrous furnish on a foraminous support;

(c) dewatering said furnish to form a web;

(d) applying said dewatered web to a heated rotating cylinder and drying said web to a consistency of greater than about 30%;

(e) creping said web from said heated cylinder at said consistency of greater than about 30% and less than about 90% with a creping blade provided with an undulatory creping surface adapted to contact said cylinder; and (f) drying said web subsequent to creping said web from said heated cylinder to form said absorbent sheet.

* * * * *